US007857052B2

(12) United States Patent
Giroux et al.

(10) Patent No.: US 7,857,052 B2
(45) Date of Patent: Dec. 28, 2010

(54) STAGE CEMENTING METHODS USED IN CASING WHILE DRILLING

(75) Inventors: Richard Lee Giroux, Cypress, TX (US); Steven M. Rosenberg, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 257 days.

(21) Appl. No.: 11/747,849

(22) Filed: May 11, 2007

(65) Prior Publication Data

US 2007/0261850 A1 Nov. 15, 2007

Related U.S. Application Data

(60) Provisional application No. 60/747,175, filed on May 12, 2006.

(51) Int. Cl.
*E21B 33/13* (2006.01)

(52) U.S. Cl. ..... 166/289; 166/291; 166/177.4; 166/154

(58) Field of Classification Search ..... 166/289, 166/154, 291, 177.4, 318
See application file for complete search history.

(56) References Cited

U.S. PATENT DOCUMENTS

| | | | | |
|---|---|---|---|---|
| 122,514 | A | | 1/1872 | Bullock |
| 1,077,772 | A | | 11/1913 | Weathersby |
| 1,185,582 | A | | 5/1916 | Bignell |
| 1,301,285 | A | | 4/1919 | Leonard |
| 1,342,424 | A | | 6/1920 | Cotten |
| 1,471,526 | A | | 10/1923 | Pickin |
| 1,830,625 | A | | 11/1931 | Schrock |
| 1,851,289 | A | | 3/1932 | Owen |
| 1,880,218 | A | | 10/1932 | Simmons |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,102,555 | A | | 12/1937 | Dyer |
| 2,184,681 | A | | 12/1939 | Osmun et al. |
| 2,187,483 | A | * | 1/1940 | Baker ..... 166/116 |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |

(Continued)

FOREIGN PATENT DOCUMENTS

| | | |
|---|---|---|
| CA | 2 307 386 | 11/2000 |

(Continued)

OTHER PUBLICATIONS

PCT Search Report, International Application No. PCT/US2007/068814, dated Dec. 12, 2007.

(Continued)

*Primary Examiner*—David J Bagnell
*Assistant Examiner*—Cathleen R Hutchins
(74) *Attorney, Agent, or Firm*—Patterson & Sheridan, L.L.P.

(57) ABSTRACT

Apparatus and methods are provided for a cementing operation for use with a drilling with casing application. In one embodiment, an apparatus is provided for stage cementing using a full opening stage tool. In another embodiment, an apparatus is provided for reverse cementing of the casing.

17 Claims, 22 Drawing Sheets

U.S. PATENT DOCUMENTS

| | | | | |
|---|---|---|---|---|
| 2,370,832 | A | | 3/1945 | Baker |
| 2,379,800 | A | | 7/1945 | Hare |
| 2,425,202 | A | | 8/1947 | Ozinga |
| 2,570,080 | A | | 10/1951 | Stone |
| 2,621,742 | A | | 12/1952 | Brown |
| 2,650,314 | A | | 8/1953 | Hennigh et al. |
| 2,696,367 | A | | 12/1954 | Robishaw |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,978,047 | A | | 4/1961 | DeVaan |
| 3,001,585 | A | | 9/1961 | Shiplet |
| 3,006,415 | A | | 10/1961 | Burns et al. |
| 3,054,100 | A | | 9/1962 | Jones |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,680 | A | | 6/1965 | Vincent |
| 3,266,582 | A | | 8/1966 | Homanick |
| 3,273,660 | A | | 9/1966 | Jackson et al. |
| 3,353,599 | A | | 11/1967 | Swift |
| 3,387,893 | A | | 6/1968 | Hoever |
| 3,412,805 | A | | 11/1968 | Gribbin et al. |
| 3,419,079 | A | | 12/1968 | Current |
| 3,550,684 | A | | 12/1970 | Cubberly, Jr. |
| 3,552,848 | A | | 1/1971 | Van Wagner |
| 3,559,739 | A | | 2/1971 | Hutchison |
| 3,575,245 | A | | 4/1971 | Cordary et al. |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,621,910 | A | | 11/1971 | Sanford et al. |
| 3,624,760 | A | | 11/1971 | Bodine |
| 3,638,989 | A | | 2/1972 | Sandquist |
| 3,656,564 | A | | 4/1972 | Brown |
| 3,669,190 | A | | 6/1972 | Sizer et al. |
| 3,691,624 | A | | 9/1972 | Kinley |
| 3,692,126 | A | | 9/1972 | Rushing et al. |
| 3,696,332 | A | | 10/1972 | Dickson, Jr. et al. |
| 3,729,057 | A | | 4/1973 | Werner |
| 3,760,894 | A | | 9/1973 | Pitifer |
| 3,776,307 | A | | 12/1973 | Young |
| 3,785,193 | A | | 1/1974 | Kinley et al. |
| 3,870,114 | A | | 3/1975 | Pulk et al. |
| 3,934,660 | A | | 1/1976 | Nelson |
| 3,935,910 | A | | 2/1976 | Gaudy et al. |
| 3,945,444 | A | | 3/1976 | Knudson |
| 3,947,009 | A | | 3/1976 | Nelmark |
| 3,948,322 | A | * | 4/1976 | Baker ..... 166/289 |
| 3,964,552 | A | | 6/1976 | Slator |
| 3,964,556 | A | | 6/1976 | Gearhart et al. |
| 4,049,066 | A | | 9/1977 | Richey |
| 4,054,426 | A | | 10/1977 | White |
| 4,064,939 | A | | 12/1977 | Marquis |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,981 | A | | 7/1978 | Chaffin |
| 4,133,396 | A | | 1/1979 | Tschirky |
| 4,173,457 | A | | 11/1979 | Smith |
| 4,175,619 | A | | 11/1979 | Davis |
| 4,182,423 | A | | 1/1980 | Ziebarth et al. |
| 4,186,628 | A | | 2/1980 | Bonnice |
| 4,189,185 | A | | 2/1980 | Kammerer, Jr. et al. |
| 4,194,383 | A | | 3/1980 | Huzyak |
| 4,202,225 | A | | 5/1980 | Sheldon et al. |
| 4,227,197 | A | | 10/1980 | Nimmo et al. |
| 4,241,878 | A | | 12/1980 | Underwood |
| 4,246,968 | A | | 1/1981 | Jessup et al. |
| 4,260,017 | A | | 4/1981 | Nelson et al. |
| 4,277,197 | A | | 7/1981 | Bingham |
| 4,281,722 | A | | 8/1981 | Tucker et al. |
| 4,287,949 | A | | 9/1981 | Lindsey, Jr. |
| 4,311,195 | A | | 1/1982 | Mullins, II |
| 4,336,415 | A | | 6/1982 | Walling |
| 4,384,627 | A | | 5/1983 | Ramirez-Jauregui |
| 4,392,534 | A | | 7/1983 | Miida |
| 4,396,076 | A | | 8/1983 | Inoue |
| 4,396,077 | A | | 8/1983 | Radtke |
| 4,407,378 | A | | 10/1983 | Thomas |
| 4,408,669 | A | | 10/1983 | Wiredal |
| 4,413,682 | A | | 11/1983 | Callihan et al. |
| 4,427,063 | A | | 1/1984 | Skinner |
| 4,445,734 | A | | 5/1984 | Cunningham |
| 4,460,053 | A | | 7/1984 | Jurgens et al. |
| 4,463,814 | A | | 8/1984 | Horstmeyer et al. |
| 4,466,498 | A | | 8/1984 | Bardwell |
| 4,470,470 | A | | 9/1984 | Takano |
| 4,474,243 | A | | 10/1984 | Gaines |
| 4,483,399 | A | | 11/1984 | Colgate |
| 4,489,793 | A | | 12/1984 | Boren |
| 4,544,041 | A | | 10/1985 | Rinaldi |
| 4,545,443 | A | | 10/1985 | Wiredal |
| 4,580,631 | A | | 4/1986 | Baugh |
| 4,583,603 | A | | 4/1986 | Dorleans et al. |
| 4,589,495 | A | | 5/1986 | Langer et al. |
| 4,593,584 | A | | 6/1986 | Neves |
| 4,595,058 | A | | 6/1986 | Nations |
| 4,605,268 | A | | 8/1986 | Meador |
| 4,610,320 | A | | 9/1986 | Beakley |
| 4,613,161 | A | | 9/1986 | Brisco |
| 4,620,600 | A | | 11/1986 | Persson |
| 4,630,691 | A | | 12/1986 | Hooper |
| 4,651,837 | A | | 3/1987 | Mayfield |
| 4,655,286 | A | | 4/1987 | Wood |
| 4,671,358 | A | | 6/1987 | Lindsey, Jr. et al. |
| 4,676,310 | A | | 6/1987 | Scherbatskoy et al. |
| 4,678,031 | A | | 7/1987 | Blandford et al. |
| 4,691,587 | A | | 9/1987 | Farrand et al. |
| 4,693,316 | A | | 9/1987 | Riggenberg et al. |
| 4,699,224 | A | | 10/1987 | Burton |
| 4,708,202 | A | | 11/1987 | Sukup et al. |
| 4,744,426 | A | | 5/1988 | Reed |
| 4,760,882 | A | | 8/1988 | Novak |
| 4,770,259 | A | | 9/1988 | Jansson |
| 4,775,009 | A | | 10/1988 | Wittrisch et al. |
| 4,778,008 | A | | 10/1988 | Gonzalez et al. |
| 4,788,544 | A | | 11/1988 | Howard |
| 4,806,928 | A | | 2/1989 | Veneruso |
| 4,825,947 | A | | 5/1989 | Mikolajczyk |
| 4,828,050 | A | | 5/1989 | Hashimoto |
| 4,836,299 | A | | 6/1989 | Bodine |
| 4,842,081 | A | | 6/1989 | Parant |
| 4,854,386 | A | | 8/1989 | Baker et al. |
| 4,858,705 | A | | 8/1989 | Thiery |
| 4,880,058 | A | | 11/1989 | Lindsey et al. |
| 4,883,125 | A | | 11/1989 | Wilson et al. |
| 4,901,069 | A | | 2/1990 | Veneruse |
| 4,904,119 | A | | 2/1990 | Legendre et al. |
| 4,915,181 | A | | 4/1990 | Labrosse |
| 4,960,173 | A | | 10/1990 | Cognevich et al. |
| 4,962,822 | A | | 10/1990 | Pascale |

5,009,265 A 4/1991 Bailey et al.
5,027,914 A 7/1991 Wilson
5,060,737 A 10/1991 Mohn
5,069,297 A 12/1991 Krueger et al.
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,141,063 A 8/1992 Quesenbury
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,197,553 A 3/1993 Leturno
5,224,540 A 7/1993 Streich et al.
5,234,052 A 8/1993 Coone et al.
5,255,741 A 10/1993 Alexander
5,271,468 A 12/1993 Streich et al.
5,271,472 A 12/1993 Leturno
5,285,008 A 2/1994 Sas-Jaworsky et al.
5,285,204 A 2/1994 Sas-Jaworsky
5,291,956 A 3/1994 Mueller et al.
5,305,830 A 4/1994 Wittrisch
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,343,950 A 9/1994 Hale et al.
5,343,951 A 9/1994 Cowan et al.
5,343,968 A 9/1994 Glowka
5,348,089 A * 9/1994 Brandell et al. ..... 166/154
5,353,872 A 10/1994 Wittrisch
5,355,967 A 10/1994 Mueller et al.
5,361,859 A 11/1994 Tibbitts
5,375,668 A 12/1994 Hallundbaek
5,379,835 A 1/1995 Streich
5,392,715 A 2/1995 Pelrine
5,394,823 A 3/1995 Lenze
5,402,856 A 4/1995 Warren et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,462,120 A 10/1995 Gondouin
5,472,057 A 12/1995 Winfree
5,477,925 A 12/1995 Trahan et al.
5,494,122 A 2/1996 Larsen et al.
5,501,280 A 3/1996 Brisco
5,520,255 A 5/1996 Barr et al.
5,526,880 A 6/1996 Jordan, Jr. et al.
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,582,259 A 12/1996 Barr
5,611,397 A 3/1997 Wood
5,613,567 A 3/1997 Hudson
5,615,747 A 4/1997 Vail, III
5,651,420 A 7/1997 Tibbitts et al.
5,655,602 A 8/1997 Collins
5,662,170 A 9/1997 Donovan et al.
5,662,182 A 9/1997 McLeod et al.
5,667,023 A 9/1997 Harrell et al.
5,685,373 A 11/1997 Collins et al.
5,697,442 A 12/1997 Baldridge
5,706,905 A 1/1998 Barr
5,717,334 A 2/1998 Vail, III et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,743,344 A 4/1998 McLeod et al.
5,755,299 A 5/1998 Langford, Jr. et al.
5,765,638 A 6/1998 Taylor
5,785,134 A 7/1998 McLeod et al.
5,787,978 A 8/1998 Carter et al.
5,791,416 A 8/1998 White et al.
5,803,666 A 9/1998 Keller
5,813,456 A 9/1998 Milner et al.
5,823,264 A 10/1998 Riggenberg
5,826,651 A 10/1998 Lee et al.
5,828,003 A 10/1998 Thomeer et al.
5,829,520 A 11/1998 Johnson
5,829,539 A 11/1998 Newton et al.
5,836,409 A 11/1998 Vail, III
5,839,515 A 11/1998 Yuan et al.
5,839,519 A 11/1998 Spedale, Jr.
5,842,149 A 11/1998 Harrel et al.
5,845,722 A 12/1998 Makohl et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,894,897 A 4/1999 Vail, III
5,907,664 A 5/1999 Wang et al.
5,908,049 A 6/1999 Williams et al.
5,913,337 A 6/1999 Williams et al.
5,921,285 A 7/1999 Quigley et al.
5,921,332 A 7/1999 Spedale, Jr.
5,947,213 A 9/1999 Angle et al.
5,950,742 A 9/1999 Caraway
5,954,131 A 9/1999 Sallawasser
5,957,225 A 9/1999 Sinor
5,984,007 A 11/1999 Yuan et al.
5,988,273 A 11/1999 Monjure et al.
6,024,169 A 2/2000 Haugen
6,026,911 A 2/2000 Angle et al.
6,035,953 A 3/2000 Rear
6,059,051 A 5/2000 Jewkes et al.
6,059,053 A 5/2000 McLeod
6,061,000 A 5/2000 Edwards
6,062,326 A 5/2000 Strong et al.
6,079,498 A 6/2000 Lima et al.
6,085,838 A 7/2000 Vercaemer et al.
6,089,323 A 7/2000 Newman et al.
6,106,200 A 8/2000 Mocivnik et al.
6,135,208 A 10/2000 Gano et al.
6,155,360 A 12/2000 McLeod
6,158,531 A 12/2000 Vail, III
6,172,010 B1 1/2001 Argillier et al.
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.

6,220,117 B1 4/2001 Butcher
6,223,823 B1 5/2001 Head
6,224,112 B1 5/2001 Eriksen et al.
6,234,257 B1 5/2001 Ciglenec et al.
6,244,342 B1 6/2001 Sullaway et al.
6,244,363 B1 6/2001 McLeod
6,263,987 B1 7/2001 Vail, III
6,273,189 B1 8/2001 Gissler et al.
6,275,938 B1 8/2001 Bond et al.
6,276,450 B1 8/2001 Seneviratne
6,290,432 B1 9/2001 Exley et al.
6,296,066 B1 10/2001 Terry et al.
6,305,469 B1 10/2001 Coenen et al.
6,311,792 B1 11/2001 Scott et al.
6,334,376 B1 1/2002 Torres
6,336,507 B1 1/2002 Collins
6,343,649 B1 2/2002 Beck et al.
6,347,674 B1 2/2002 Bloom et al.
6,357,485 B2 3/2002 Quigley et al.
6,359,569 B2 3/2002 Beck et al.
6,367,552 B1 4/2002 Scott et al.
6,367,566 B1 4/2002 Hill
6,371,203 B2 4/2002 Frank et al.
6,374,506 B1 4/2002 Schutte
6,374,924 B1 4/2002 Hanton et al.
6,378,627 B1 4/2002 Tubel et al.
6,378,633 B1 4/2002 Moore
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,574 B1 7/2002 Wardley et al.
6,415,877 B1 7/2002 Fincher et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,443,241 B1 9/2002 Juhasz et al.
6,443,247 B1 * 9/2002 Wardley ..... 175/402
6,446,723 B1 9/2002 Ramons et al.
6,464,004 B1 10/2002 Crawford et al.
6,464,011 B2 10/2002 Tubel
6,484,818 B2 11/2002 Alft et al.
6,494,272 B1 12/2002 Eppink et al.
6,497,280 B2 12/2002 Beck et al.
6,497,289 B1 12/2002 Cook et al.
6,527,064 B1 3/2003 Hallundbaek
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,554,063 B2 4/2003 Ohmer
6,554,064 B1 4/2003 Restarick et al.
6,571,868 B2 6/2003 Victor
6,585,040 B2 7/2003 Hanton et al.
6,591,905 B2 7/2003 Coon
6,612,383 B2 9/2003 Desari et al.
6,619,402 B1 9/2003 Amory et al.
6,634,430 B2 10/2003 Dawson et al.
6,640,903 B1 11/2003 Cook et al.
6,655,460 B2 12/2003 Bailey et al.
6,666,274 B2 12/2003 Hughes
6,668,937 B1 12/2003 Murray
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,732,822 B2 5/2004 Slack et al.
6,742,584 B1 6/2004 Appleton
6,742,591 B2 6/2004 Metcalfe
6,742,606 B2 6/2004 Metcalfe et al.
6,745,834 B2 6/2004 Davis et al.
6,752,211 B2 6/2004 Dewey et al.
6,758,278 B2 7/2004 Cook et al.
6,776,233 B2 8/2004 Meehan
6,802,374 B2 10/2004 Edgar et al.
6,837,313 B2 1/2005 Hosie et al.
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway
6,863,129 B2 3/2005 Ohmer et al.
6,868,906 B1 3/2005 Vail, III et al.
6,877,553 B2 4/2005 Cameron
6,892,819 B2 5/2005 Cook et al.
6,896,075 B2 5/2005 Haugen et al.
6,899,186 B2 5/2005 Galloway et al.
6,899,772 B1 5/2005 Morando
6,920,932 B2 7/2005 Zimmerman
6,923,255 B2 8/2005 Lee
6,941,652 B2 9/2005 Echols et al.
6,953,096 B2 10/2005 Gledhill et al.
7,000,695 B2 2/2006 Steele et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,066,267 B2 6/2006 Hall
7,082,997 B2 8/2006 Slack
7,083,005 B2 8/2006 Galloway et al.
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
7,195,085 B2 3/2007 Pia
7,216,727 B2 5/2007 Wardley
7,219,727 B2 5/2007 Slack et al.
7,219,730 B2 5/2007 Tilton et al.
7,234,526 B2 6/2007 Steele et al.
7,234,546 B2 6/2007 Vincent et al.
7,240,728 B2 7/2007 Cook et al.
2002/0066556 A1 6/2002 Goode et al.
2003/0042022 A1 3/2003 Lauritzen et al.
2003/0056991 A1 3/2003 Hahn et al.
2003/0070841 A1 4/2003 Merecka et al.
2003/0183424 A1 10/2003 Tulloch
2004/0011534 A1 1/2004 Simonds et al.

| | | | | |
|---|---|---|---|---|
| 2004/0060700 | A1 | 4/2004 | Vert et al. | |
| 2004/0118560 | A1 | 6/2004 | Johnson et al. | |
| 2004/0118613 | A1* | 6/2004 | Vail, III | 175/65 |
| 2004/0216892 | A1 | 11/2004 | Giroux et al. | |
| 2004/0221997 | A1 | 11/2004 | Giroux et al. | |
| 2004/0238218 | A1 | 12/2004 | Runia et al. | |
| 2004/0244992 | A1 | 12/2004 | Carter et al. | |
| 2004/0245020 | A1 | 12/2004 | Giroux et al. | |
| 2004/0262013 | A1 | 12/2004 | Tilton et al. | |
| 2005/0051343 | A1 | 3/2005 | Pietras et al. | |
| 2005/0152749 | A1 | 7/2005 | Anres et al. | |
| 2005/0183892 | A1 | 8/2005 | Oldham et al. | |
| 2005/0274547 | A1 | 12/2005 | Fincher et al. | |
| 2006/0070771 | A1 | 4/2006 | McClain et al. | |
| 2007/0068703 | A1 | 3/2007 | Tessari et al. | |
| 2007/0079995 | A1 | 4/2007 | McClain et al. | |

FOREIGN PATENT DOCUMENTS

| | | |
|---|---|---|
| CA | 2 335 192 | 11/2001 |
| DE | 3 213 464 | 10/1983 |
| DE | 3 918 132 | 12/1989 |
| DE | 4 133 802 | 10/1992 |
| EP | 0 235 105 | 9/1987 |
| EP | 0 265 344 | 4/1988 |
| EP | 0 426 123 | 5/1991 |
| EP | 0 462 618 | 12/1991 |
| EP | 0 554 568 | 8/1993 |
| EP | 0 571 045 | 11/1993 |
| EP | 0 790 386 | 8/1997 |
| EP | 0 881 354 | 4/1998 |
| EP | 0 962 384 | 12/1999 |
| EP | 1 006 260 | 6/2000 |
| EP | 1 050 661 | 11/2000 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 2 115 940 | 9/1983 |
| GB | 2 170 528 | 8/1986 |
| GB | 2 216 926 | 10/1989 |
| GB | 2 221 482 | 2/1990 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 348 223 | 9/2000 |
| GB | 2 349 401 | 11/2000 |
| GB | 2 357 101 | 6/2001 |
| GB | 2 352 747 | 7/2001 |
| GB | 2 372 765 | 9/2002 |
| GB | 2 382 361 | 5/2003 |
| GB | 2 389 130 | 12/2003 |
| GB | 2 393 988 | 4/2004 |
| JP | 2001-173349 | 6/2001 |
| WO | WO 82-01211 | 4/1982 |
| WO | WO 92-01139 | 1/1992 |
| WO | WO 98-09053 | 3/1998 |
| WO | WO 99-50528 | 10/1999 |
| WO | WO 00-28188 | 5/2000 |
| WO | WO 00-46484 | 8/2000 |
| WO | WO 00-50732 | 8/2000 |
| WO | WO 00-66879 | 11/2000 |
| WO | WO 02-14649 | 2/2002 |
| WO | WO 02-44601 | 6/2002 |
| WO | WO 02-086287 | 10/2002 |
| WO | WO 03-087525 | 10/2003 |

OTHER PUBLICATIONS

U.S. Appl. No. 10/618,093, filed Jul. 11, 2003.

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M. Gelfgat, "Retractable Bits Development and Application" Transactions of the ASME, vol. 120, Jun. 1998, pp. 124-130.

Dean E. Gaddy, Editor, "Russia Shares Technical Know-How with U.S." Oil & Gas Journal, Mar. 1999, pp. 51-52 and 54-56.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while-Drilling: The Next Step Change in Well Construction," World Oil, Oct. 1999, pp. 34-40.

De Leon Mojarro, "Breaking a Paradigm: Drilling With Tubing Gas Wells," SPE Paper 40051, SPE Annual Technical Conference and Exhibition, Mar. 3-5, 1998, pp. 465-472.

De Leon Mojarro, "Drilling/Completing With Tubing Cuts Well Costs by 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPE/IADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000 pp. 1-11.

Warren, et al., "Drilling Technology: Part I—Casing Drilling With Directional Steering In The U.S. Gulf Of Mexico," Offshore, Jan. 2001, pp. 50-52.

Warren, et al., "Drilling Technology: Part II—Casing Drilling With Directional Steering In The Gulf Of Mexico," Offshore, Feb. 2001, pp. 40-42.

Editor, "Tesco Finishes Field Trial Program," Drilling Contractor, Mar./Apr. 2001, p. 53.

Shephard, et al., Casing Drilling: An Emerging Technology, SPE Drilling & Completion, Mar. 2002, pp. 4.14.

Shephard, et al., Casing Drilling Successfully Applied in Southern Wyoming, World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al., "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-030609, World Oil Casing Drilling Technical Conference, Mar. 6-7, 2003, pp. 1-7.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Maute, "Electrical Logging: State-of-the Art," The Log Analyst, May-Jun. 1992, pp. 206-227.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Valves Wellhead Equipment Safety Systems, W-K-M Division, ACF Industries, Catalog 80, 1980, 5 Pages.
Alexander Sas-Jaworsky and J. G. Williams, Development of Composite Coiled Tubing for Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 36927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, IADC/SPE 39349, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Tessari, Robert M., Warren, Tommy, and Houtchens, Bruce, Retrievable Tools Provide Flexibility for Casing Drilling, World Oil, Casing Drilling Technical Conference, WOCD-0306-01, 2003, pp. 1-11.
Multilateral Case History, Onshore-Nigeria, Baker Hughes, 2000.
Multilateral Case History, Offshore Norway, Baker Hughes 1995.
Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.
Charles O. Vail and Verne Smith, New Developments in Air-Gas Drilling and Completions, World Oil, Part One, Nov. 1963, pp. 70-73.
Charles O. Vail and Verne Smith, New Developments in Air-Gas Drilling and Completions, World Oil, Part Two, Dec. 1963, pp. 82-86.
PCT Search Report, International Application No. PCT/US2007/068814, dated Oct. 23, 2007.

* cited by examiner

STAGE CEMENTING METHODS USED IN CASING WHILE DRILLING

CROSS REFERENCE TO RELATED APPLICATIONS

The application claims benefit of U.S. Provisional Patent Application Ser. No. 60/747,175, filed on May 12, 2006, which application is incorporated herein by reference in its entirety.

BACKGROUND OF THE INVENTION

1. Field of the Invention

Embodiments of the present invention relate to apparatus and methods for forming a wellbore, lining a wellbore, and circulating fluids in the wellbore. Particularly, the present invention relates to apparatus and methods for cementing a wellbore formed by drilling with casing. More particularly, embodiments of the present invention also relate to apparatus and methods for stage cementing a wellbore.

2. Description of the Related Art

In the drilling of oil and gas wells, drilling with casing is a method of forming a borehole with a drill bit attached to the same string of casing that will line the borehole. In other words, rather than run a drill bit on smaller diameter drill string, the bit is run at the end of larger diameter casing that will remain in the wellbore and be cemented therein. Because the same string of casing transports the bit and lines the borehole, no separate trip out of or into the wellbore is necessary between the forming of the borehole and the lining of the borehole. Drilling with casing is especially useful in certain situations where an operator wants to drill and line a borehole as quickly as possible to minimize the time the borehole remains unlined and subject to collapse or the effects of pressure anomalies. For example, when forming a sub-sea borehole, the initial length of borehole extending from the sea floor is much more subject to cave in or collapse than the subsequent sections of borehole. Sections of a borehole that intersect areas of high pressure can lead to damage of the borehole between the time the borehole is formed and when it is lined. An area of exceptionally low pressure will drain expensive drilling fluid from the wellbore between the time it is intersected and when the borehole is lined. In each of these instances, the problems can be eliminated or their effects reduced by drilling with casing.

After drilling to a predetermined depth, a cementing operation is performed. The cementing operation fills the annular space between the outer diameter of a casing and the earth with cement. The cement will set the casing in the wellbore and facilitate the isolation of production zones and fluids at different depths within the wellbore. Currently, cement flows into the annulus from the bottom of the casing (e.g., cementing the long way) or the top of the casing (e.g., reverse cementing). Due to weak earth formations or long strings of casing, cementing from the top or bottom of the casing may be undesirable or ineffective. When circulating cement into the annulus from the bottom of the casing, problems may be encountered as the cement on the outside of the annulus rises. For example, if a weak earth formation exists, it will not support the cement. As a result, the cement will flow into the formation rather than up the casing annulus. When cementing from the top of the casing it is often difficult to ensure the entire annulus is cemented.

There is, therefore, a need for apparatus and methods of cementing the drilling casing of a drilling with casing operation. There is also a need for apparatus and methods of cementing a casing string at intermediate points. A need also exists for cementing a casing string at intermediate points using a full bore stage tool.

SUMMARY OF THE INVENTION

The present invention generally relates to methods and apparatus for cementing a wellbore. In one embodiment, the wellbore is formed by drilling a wellbore with a drilling member coupled to the end of a casing, opening a port in a wall of the casing, and circulating cement through the port.

In one embodiment, a method of cementing a wellbore includes drilling the wellbore using a drilling member coupled to a casing; performing a first cementing operation; opening a stage tool located in the casing string; and performing a second cementing operation through the stage tool. In another embodiment, a plurality of plugs are used to perform the first and second cementing operations. In yet another embodiment, the drilling member is removed prior to performing the first cementing operation. In another embodiment, the stage tool may be a full bore stage tool.

In another embodiment, an apparatus for forming a wellbore includes a casing string having a drilling member disposed at a lower end; a cementing stage tool disposed at an intermediate location on the casing string; a one way valve disposed at a lower portion of the casing string; and an operating tool for controlling the stage tool. In yet another embodiment, the stage tool includes a sliding sleeve for regulating flow through the stage tool. In yet another embodiment, the drilling member is retrievable from the casing string. In yet another embodiment, the drilling member is latched to a profile in the casing string.

In another embodiment, an apparatus for cementing a wellbore includes an outer string and an inner string adapted to engage an interior of the outer string, wherein fluid may be circulated down the inner string, out of a port in the outer string, back into the outer string, and up the inner string. The outer string includes a casing string; an annular packer; a selectively actuatable port for fluid communication with an exterior of the outer string; and a valve disposed at a lower portion of the outer string. The inner string includes a bypass port; a reverse port; and an outer string engagement member.

In another embodiment, a method of cementing a tubular in a wellbore includes providing the tubular with a port collar disposed above a valve; positioning an inner string in the tubular; opening a port in the port collar; opening the valve; circulating cement down the inner string and out of the port to an exterior of the tubular; and circulating cement in the exterior through the valve and up the inner string.

In another embodiment, a method of cementing a wellbore includes drilling the wellbore using a drilling member coupled to a casing; opening a stage tool positioned at an intermediate location in the casing string; and performing a cementing operation through the stage tool. In yet another embodiment, the method may include performing an optional cementation through the lower end of the casing.

In one or more of the embodiments described herein, the provision and inflation of the packer on the stage tool may be optional.

In one or more of the embodiments described herein, the stage tool may be used to cement an intermediation portion of the casing without cementing through a lower portion of the casing. In yet another embodiment, the stage tool cementation may be performed with or without the isolation packer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention relates to cementing methods, techniques, and equipment that may be used with drilling with casing systems including multiple stage cementing. In one embodiment, a casing string is coupled to a drilling member at the lower end, and one or more stage cementing tools are positioned at predetermined locations in the casing string for cementing at intermediate locations of the casing. In operation, the drilling member drills a wellbore while attached to the casing either by rotating the casing or using a mud motor coupled to the drilling member or a combination of both. The casing can be rotated by any means known in the art, for example a top drive, a power tong or a rotary table. Once the casing is at a desired depth, a first cementing operation is performed through the lower end of the casing. After the first cementing operation is completed, a second cementing operation is performed using the stage tool at a predetermined location above the bottom of the casing. The second cementing operation is performed by opening a port in the stage tool and circulating cement through the port. The port is closed after cementing has been completed. Any number of additional cementing operations may be performed at desired locations on the drill string.

Figure 1:
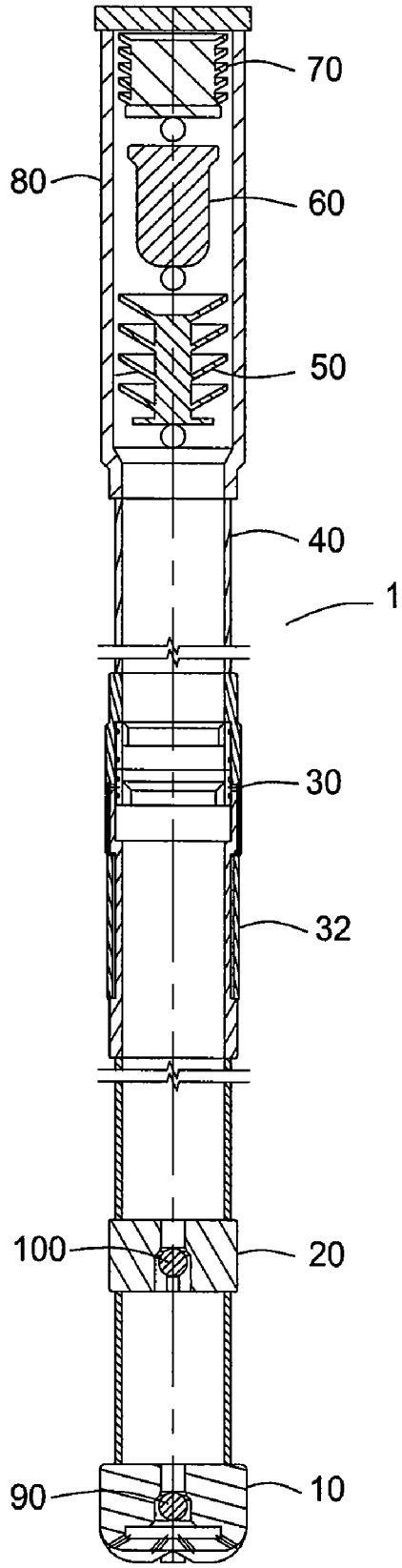
FIG. 1 is a schematic of a casing string and stage tool according to one embodiment of the present invention.

FIG. 1 shows a schematic drawing of an embodiment of the present invention. An assembly 1 is shown which includes a drilling member 10, a collar 20, a stage tool 30, all coupled to a casing string 40. The drilling member 10, the collar 20, and the stage tool 30 can be coupled to the casing at the wellbore or prior to being transported to the wellbore. Also shown in FIG. 1 is a first stage plug 50, an opening plug 60, and a closing plug 70. As shown, the plugs are positioned within a plug container 80 which is coupled to the casing 40, however, it should be appreciated that any method of delivering the plugs to the casing 40 may be used.

The drilling member 10, shown in FIG. 1, is a drill shoe that does not have to be retrieved from the bottom of the casing prior to cementing. The drilling member 10 will typically include one or more valves 90. Further, the collar 20 will optionally include one or more valves 100. The valves 90 and 100 are typically one way valves.

The stage tool 30 may be a plug operated stage tool such as hydraulically opened stage tools. The stage tool may also include an optional packer 32, as shown in FIGS. 2A-D. In one embodiment, the stage tool may be a full bore (also referred to as "full opening") stage tool. FIG. 3A shows an exemplary stage tool suitable for use with embodiments of the present invention. In operation, an opening plug 60 is launched into the inner diameter of the casing and lands in a seat 34 of the opening sleeve 33 in the stage tool 30, as shown in FIG. 3B. Then, pressure is applied to the inner diameter of the casing to shear the shear screws 35 holding the opening sleeve 33 in place. In one embodiment, the shear screws 35 are double shear, e.g., they shear once to open and again to close. The sleeve 33 then shifts down, thereby aligning ports 36, 37 to open the stage tool 30 to allow fluid flow between the casing inner diameter and the annulus between the stage tool and the drilled hole or a previously run casing. Rotational alignment of the ports 36,37 is maintained by anti-rotation pin 38*p* and anti-rotation slot 38*s*. The sleeve 33 is stopped when the locking lug 39 reaches its lower limit of travel. An optional external packer 32 may be used on the outer diameter of the stage tool 30. The packer 32 may be mechanical compression set or inflatable. The packer 32 will set to isolate the lower annulus from the upper annulus. A secondary opening mechanism (not shown) such as a sleeve or a rupture disk will then open, thereby allowing fluid to flow into the annulus above the pack-off packer. Referring to FIG. 3B, after opening the ports 36, 37, cement is supplied and the closing plug 70 is pumped behind the cement. The closing plug 70 lands in and sealingly engages the closing seat 42. Fluid pressure is supplied to shear the shear screws 35 for a second time and shift the locking lug 39, thereby allowing the closing plug 70 to shift the sleeve 33 downward to close the port 36, as shown in FIG. 3C.

Figure 2A:
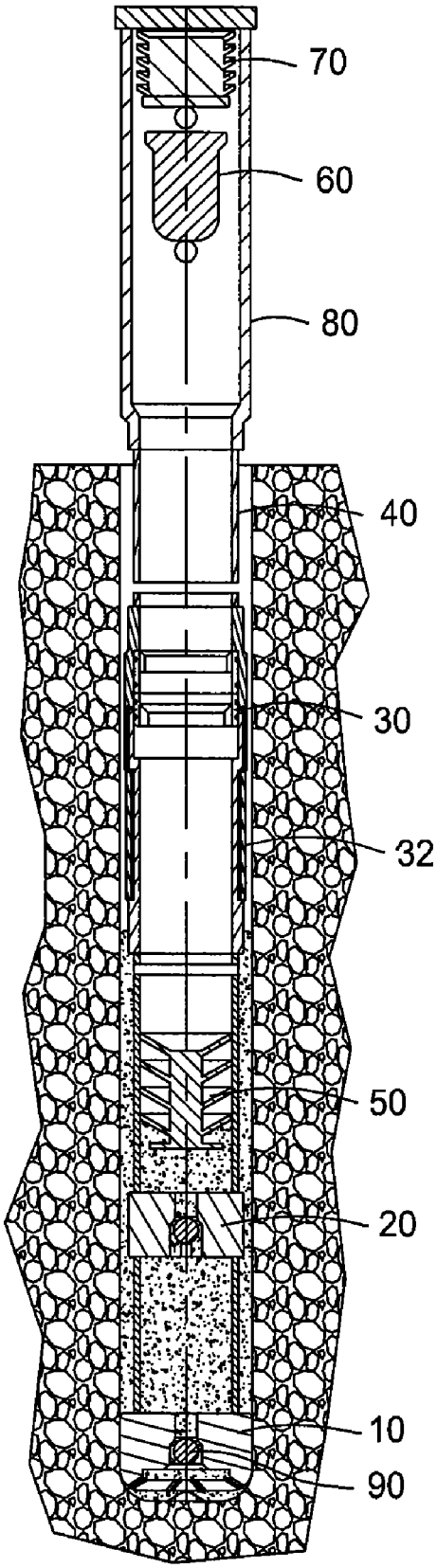
FIGS. 2A-2D shows a sequential operation of cementation of the casing string using the stage tool.
Figure 2B:
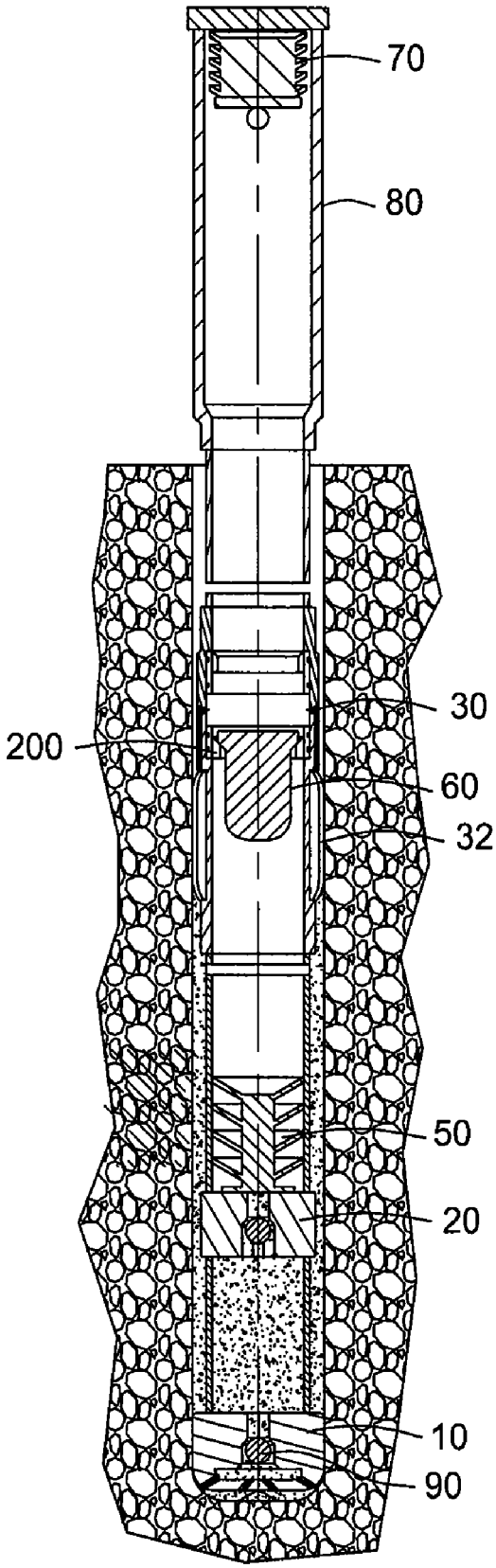

FIGS. 2A-2D show a schematic of a two stage drilling operation according to one embodiment of the present invention. FIG. 2A shows the first stage of the cementing operation almost complete. The drilling member 10 has been drilled to the desired depth. The first stage plug 50 has been dropped. The first stage plug 50 is pushed down the casing using fluid pressure. The first stage plug 50 follows the cement supplied during the first stage until the plug 50 lands the collar 20 (or optionally, the drilling member 10). In another embodiment, a plug with a by-pass feature may precede the first stage plug 50. Once the first stage plug 50 reaches its end point, the cementing of the lower end (i.e., first stage) of the casing is complete, as shown in FIG. 2B.

With the first stage cementing operation complete, the opening plug 60 is dropped, as shown in FIG. 2B. The opening plug 60 land in and sealingly engage the seat 200 of the stage tool 30. A port 37 in the stage tool 30 is then opened using fluid pressure above the opening plug 60, as described above. Although the stage tool 30 is shown operating with fluid pressure, it should be appreciated that any method of opening the stage tool may be used, as will be described in more detail below.

Figure 2C:
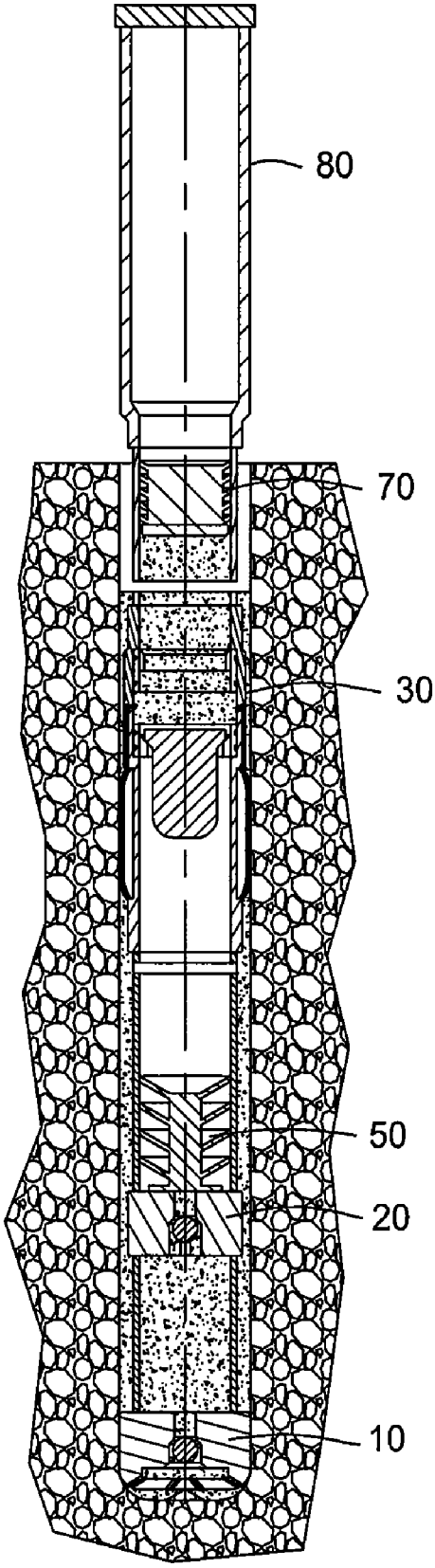
Figure 2D:
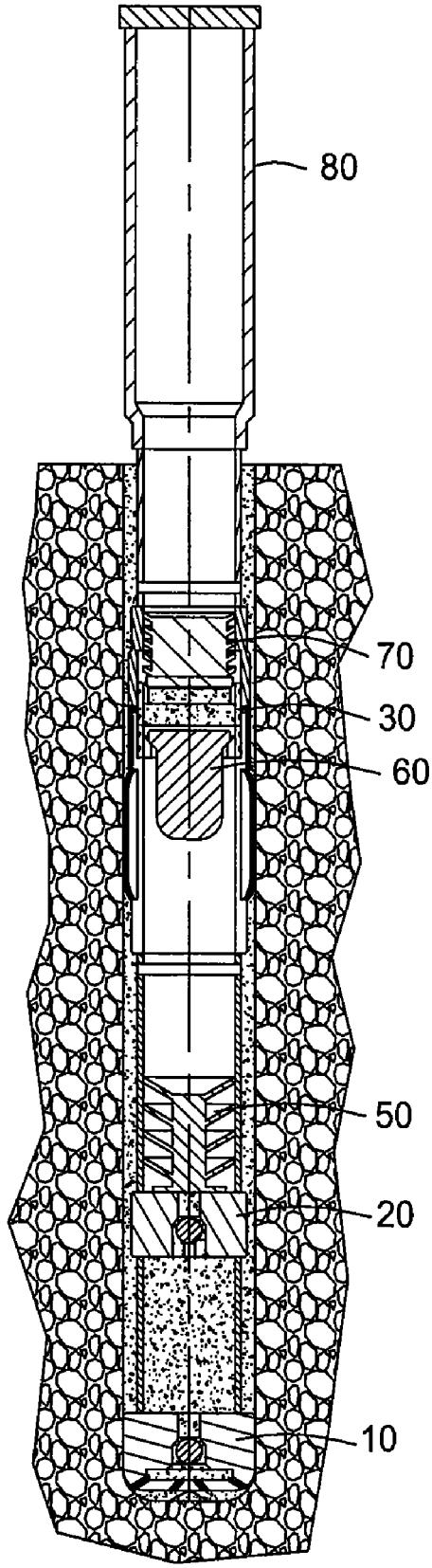
Figure 3A:
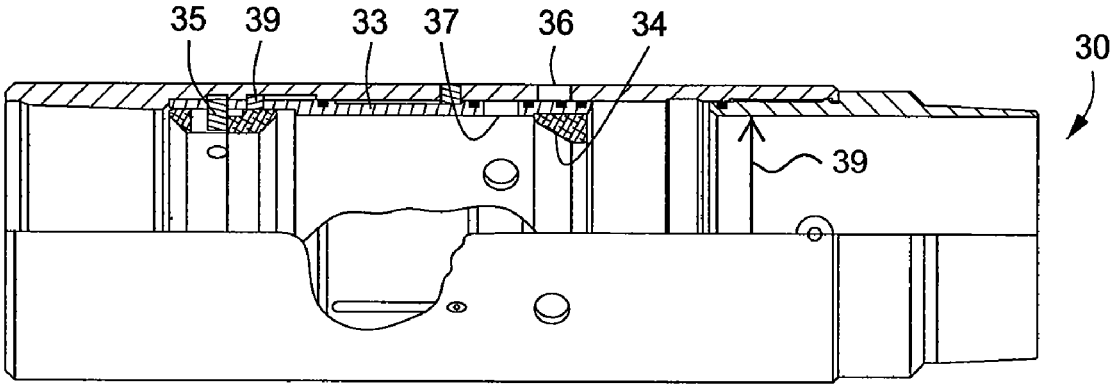
FIGS. 3A-3C is a schematic of an exemplary stage tool according to one embodiment of the present invention.
Figure 3B:
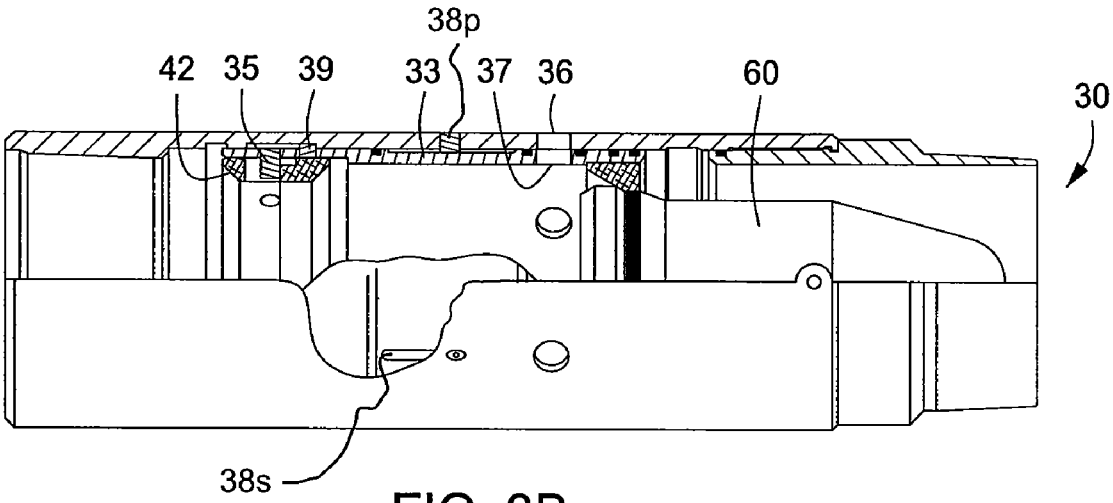
Figure 3C:
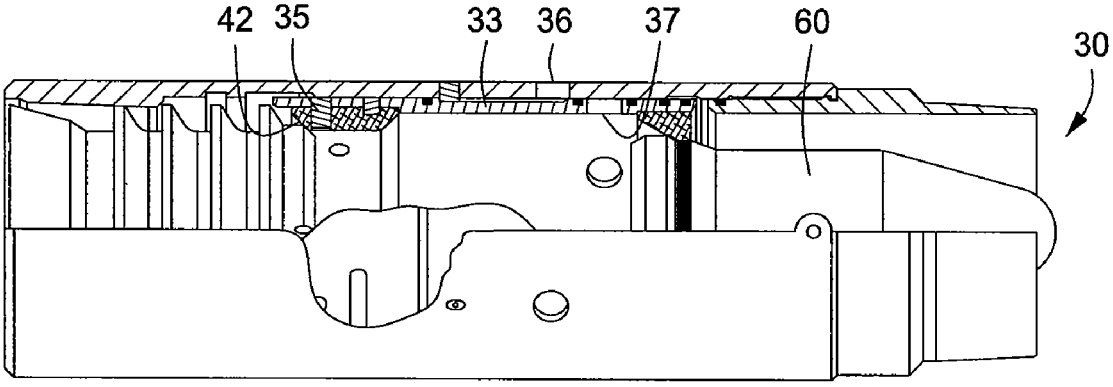

With the stage tool 30 open and the opening plug 60 sealing the casing below the stage tool 30, the second stage of cementing begins. Cement is pushed down the interior of the casing 40 and out the stage tool 30 ports 36, 37. The cement is followed by the closing plug 70, as shown in FIG. 2C. When the closing plug 70 reaches the stage tool 30, fluid pressure is supplied behind the plug 70 to close the port 36 in the stage tool 30. At this time the second stage of cementing is complete, as shown in FIG. 2D. If necessary, additional stage cementing operations may be performed above the second stage cementing operation. The plugs 50, 60, and 70 along with the drilling member 10 and the collar 20 may then be drilled out by the following drill string. The drill out diameter 39 is illustrated in FIG. 3A.

Once the stage tool is opened, circulation is established between the casing inner diameter and the annulus between the outer diameter of the stage tool and drill casing outer diameter and the inner diameter of the drilled hole or the previously run casing inner diameter. Cement is then pumped down the casing inner diameter up the annulus. The cement is followed by the top closing plug. The plug is landed on the stage tool and closes it. The closing plug, the drillable portion of the closing and opening seats and the free fall opening plug along with the first stage top plug, float collar, and drill shoe are drilled out by the following drill string. (It should be noted that a third stage, two separate stage tools, may be run in this application if the operator deems it necessary.)

In another embodiment, prior to cementing, a ball may be released into the casing to operate a tool disposed below the stage tool. For example, a ball may be dropped to convert a drill shoe. After the ball lands in the drill shoe, pressure may be applied to displace the blades toward the annular area. In this respect, the next drill string may pass through the casing without drilling through the blades of the drill shoe. An exemplary convertible drill shoe is manufactured by Weatherford International. A suitable convertible drill shoe is disclosed in U.S. Pat. No. 6,443,247, which is incorporated herein by reference in its entirety.

Figure 2E:
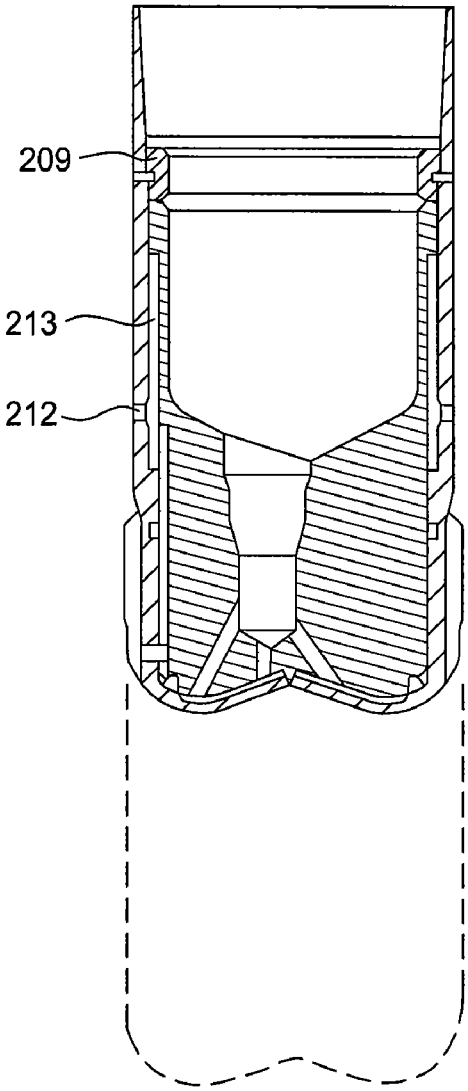
FIG. 2E illustrates the shoe of the '247 patent in drilling mode.
Figure 2F:
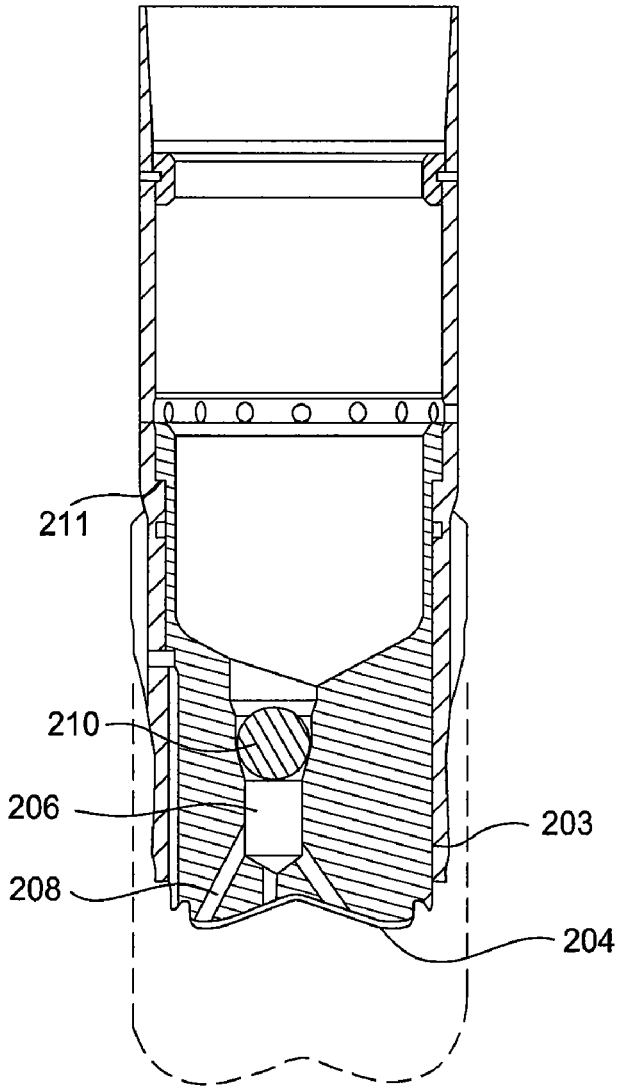
FIG. 2F illustrates the shoe activated for cementing and subsequent drilling.
Figure 2G:
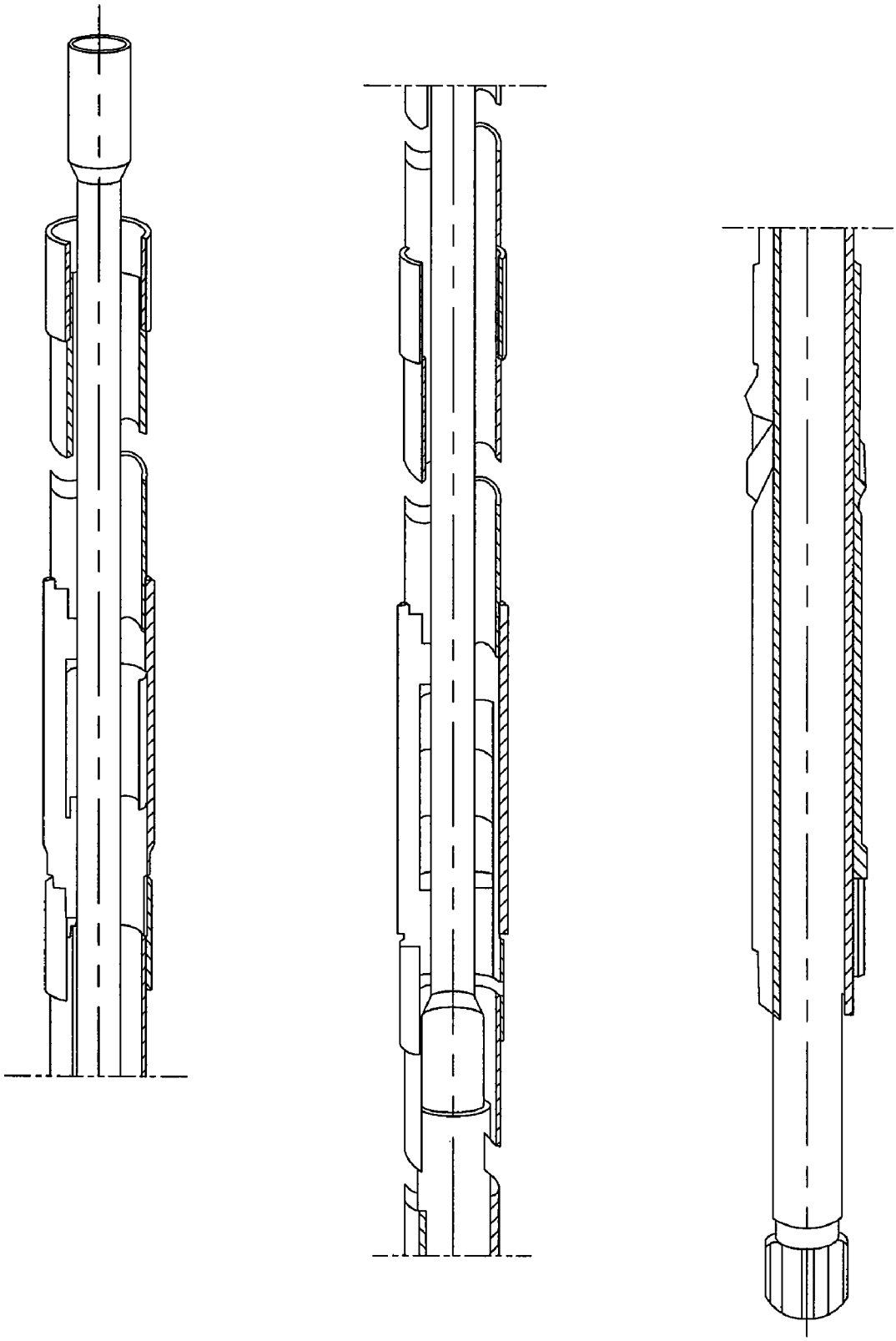
FIG. 2G illustrates the shoe being drilled.

FIG. 2E illustrates the shoe 200 of the '247 patent in drilling mode. FIG. 2F illustrates the shoe 200 activated for cementing and subsequent drilling. In the drilling mode, drilling mud may be pumped down the inside of the casing, through the bore 206 and subsequently through the ports in the inner section 204. The mud, while providing a lubricant, also serves to clean the face of the tool and is able to return up the annulus between the casing and the well bore. During this process, there would be a small downward thrust on the inner section 204 due to the pressure drop of the mud passing through the ports. This thrust would not be sufficient to displace the blades 203 of the outer section 202 relative to the rest of the shoe 200. However, when the drilling process is complete, the shoe 200 may be manipulated or activated to render it drillable. Activation may be achieved by blocking the bore 206 or flow passages 208 feeding the ports by landing a ball 210 on the seat 207. The ball 210 may be dropped from surface or may be released from a remotely actuated mechanism positioned just above the shoe 200. After the ball 210 is seated, pump pressure rises and the downward thrust load on the inner section 204 increases. This thrust load is transferred to the blades 203 positioned at the leading end of the shoe 201. The design of the blades 203 is such that they can he displaced by a predetermined load, well below the maximum safe pressure that the casing can withstand. When this load is reached, the blades 203 are displaced outwardly in the manner of downward pointing fingers, while the inner section 204 advances downwardly until its motion is arrested by mating shoulder portions 211 of the inner and outer sections 202, 204.

It is to be further noted that the outer section 2 is provided with ports 212. In the normal drilling mode, the ports 212 are obstructed by the sleeve 213 as circulation is enabled via the ports. However, the fluid communication ports 212 are caused to open, that is become unobstructed as the sleeve 213 travels down with the inner section 204 under the influence of the downward thrust. This fulfils the necessary requirement of re-establishing circulation at this point, since the cementing operation involves pumping the cement slurry down the inside of the casing and displacing it into the annulus. Cementing of the casing may then be undertaken and after the cement has set hard, drilling the next of hole section may commence. This would typically involve passing a drill bit of appropriate diameter through the center of the casing string and performing a drilling out operation of the inner section 204. As the inner section 204 is made of a readily drillable material, such as aluminum, this does not present any of the difficulties encountered in the past.

Figure 4:
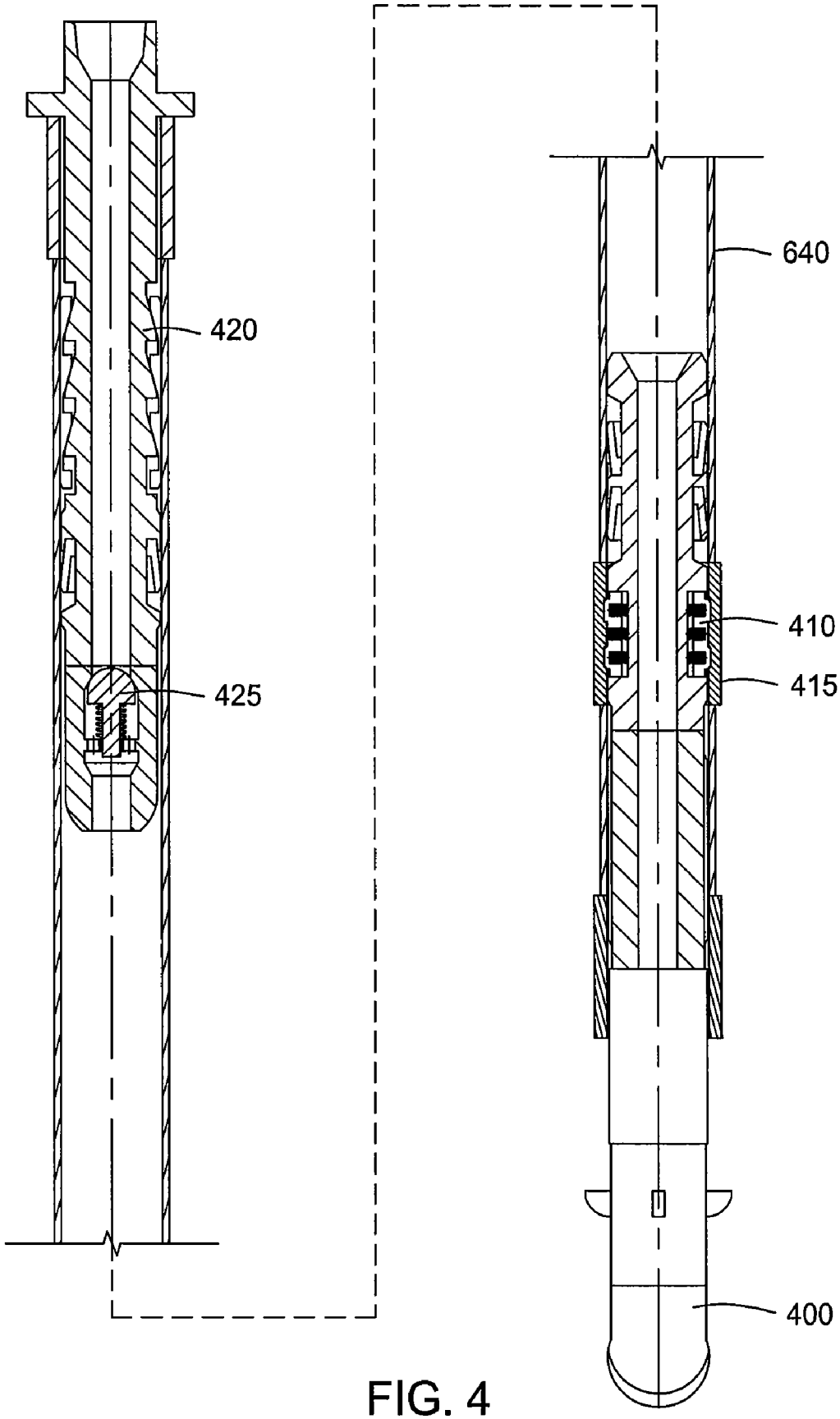
FIG. 4 shows a casing string equipped with a retrievable drilling member.

FIG. 4 shows another embodiment of a drilling with casing assembly. The assembly includes a retrievable drilling assembly 400 coupled to the casing 640. The retrievable drilling assembly includes a latch 410 adapted to couple to profile 415 in the casing 640. The drilling with casing assembly is shown supported by a spear 420. A mud saver valve 425 is connected to a lower portion of the spear. The latch 410 allows the drilling assembly 400 to be removed from the casing 640 and pulled out of the well prior to cementation. Examples of retrievable bottom hole drilling assembly are disclosed in Patent Application numbers: 2005/0000691, 2004/0245020, 2004/0221997, 2004/0216892, which are herein incorporated by reference in their entirety.

Figure 5:
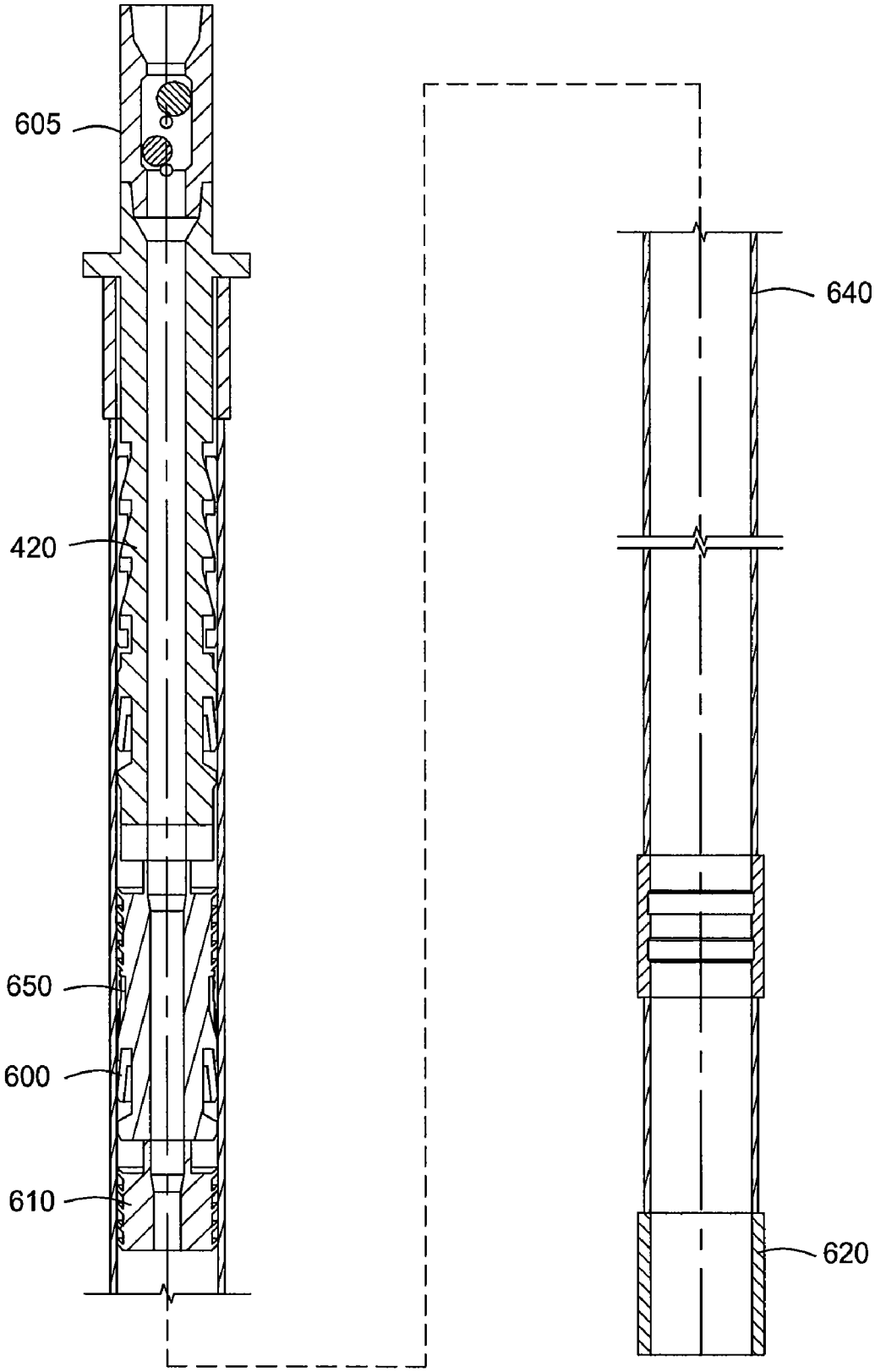
FIG. 5 shows the casing string of FIG. 4 after the drilling member has been removed. An embodiment of a cementing assembly has been disposed in the casing string.

FIG. 5 shows an apparatus for cementing the casing 640 after the drilling assembly 400 is retrieved. A one way top plug 600 is suspended below the surface torque apparatus such as a drilling spear 420 or torque head, as shown in FIG. 5. The mud saver valve 425 has been removed from the spear 420, as compared to FIG. 4. The top plug 600 includes gripping members such as slips 650 that allow the top plug 600 to move in one direction, but are activated to prevent movement in the other direction. An exemplary one way top plug is described in U.S. Patent Application No. 2004/0251025, which is incorporated by reference in its entirety. Disposed below the top plug 600 is an optional, releasable bottom plug 610. A cementing head 605 is connected above the spear 420 in order to drop a ball or dart into the casing 640.

Figure 6A:
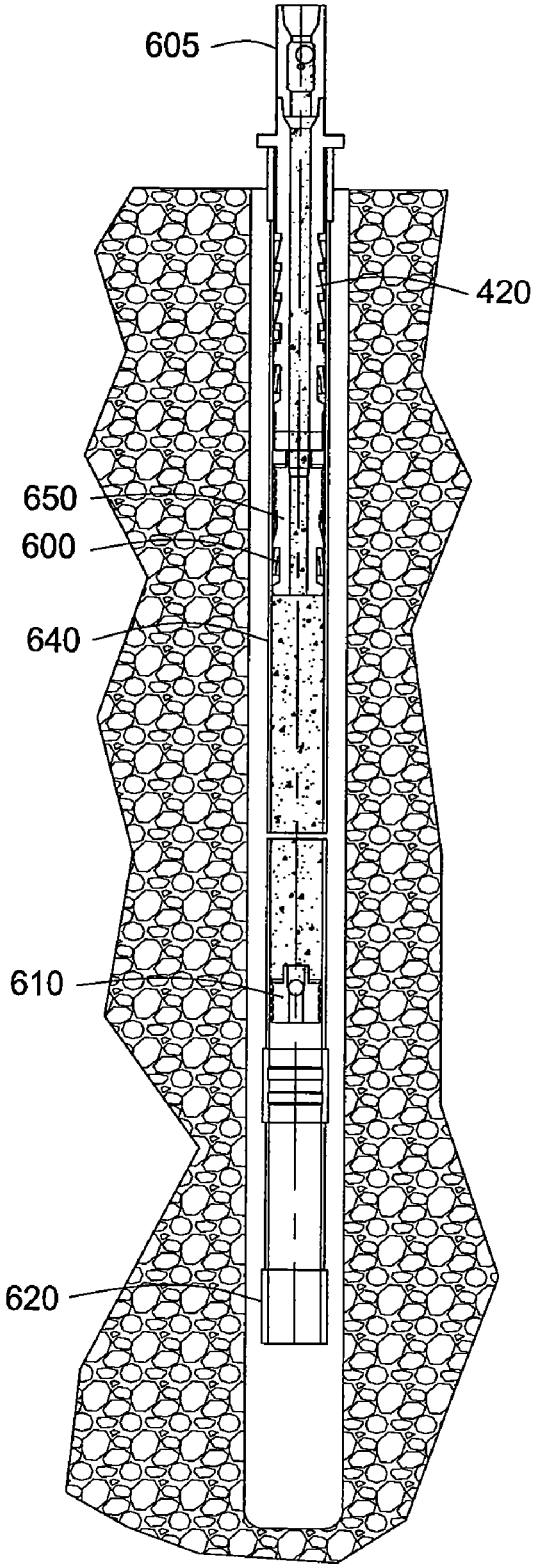
FIGS. 6A-6B shows a sequential operation of cementation of the casing string shown in FIG. 5.
Figure 6B:
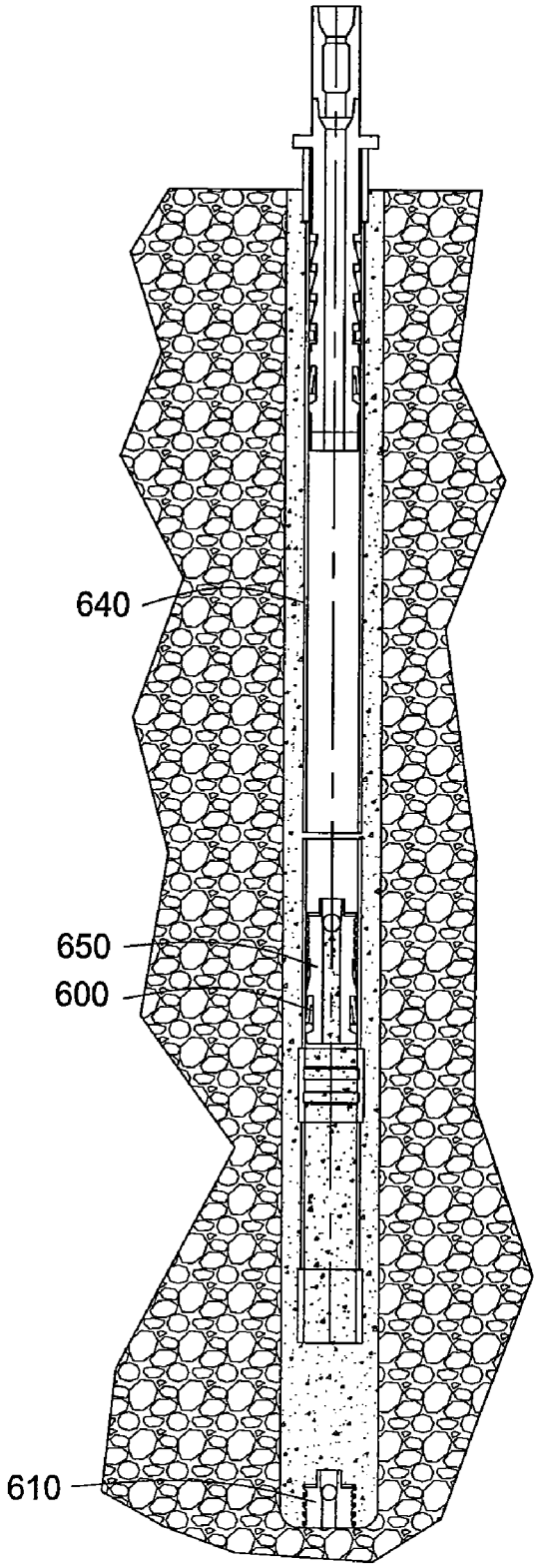

FIGS. 6A and 6B show a schematic of a cementing operation according to an embodiment of the present invention. The bottom plug 610 is launched ahead of the cement followed by the one way top plug 600 behind the cement. The bottom plug 610 may be launched by dropping a first ball into the plug 610. The bottom plug 610 acts to separate the cement from a fluid ahead of the cement. When the bottom plug 610 reaches the casing shoe 620, it exits the casing 640 and falls to the bottom of the hole. The one way top plug 600 is launched by dropping a second ball into the plug 600. The top plug 600 is stopped after a specified amount of fluid has been displaced behind the one way top plug 600, as shown in FIG. 6B. When the cement tries to U-tube, the slips 650 on the one way top plug 600 activate and keep the top plug 600 and the cement from moving back up the inner diameter of the casing 640. The top plug 600 remains in place while the cement cures. During the cementation, the spear 420 may remain attached to the casing 640 to support the casing 640 in the wellbore.

Figure 6C:
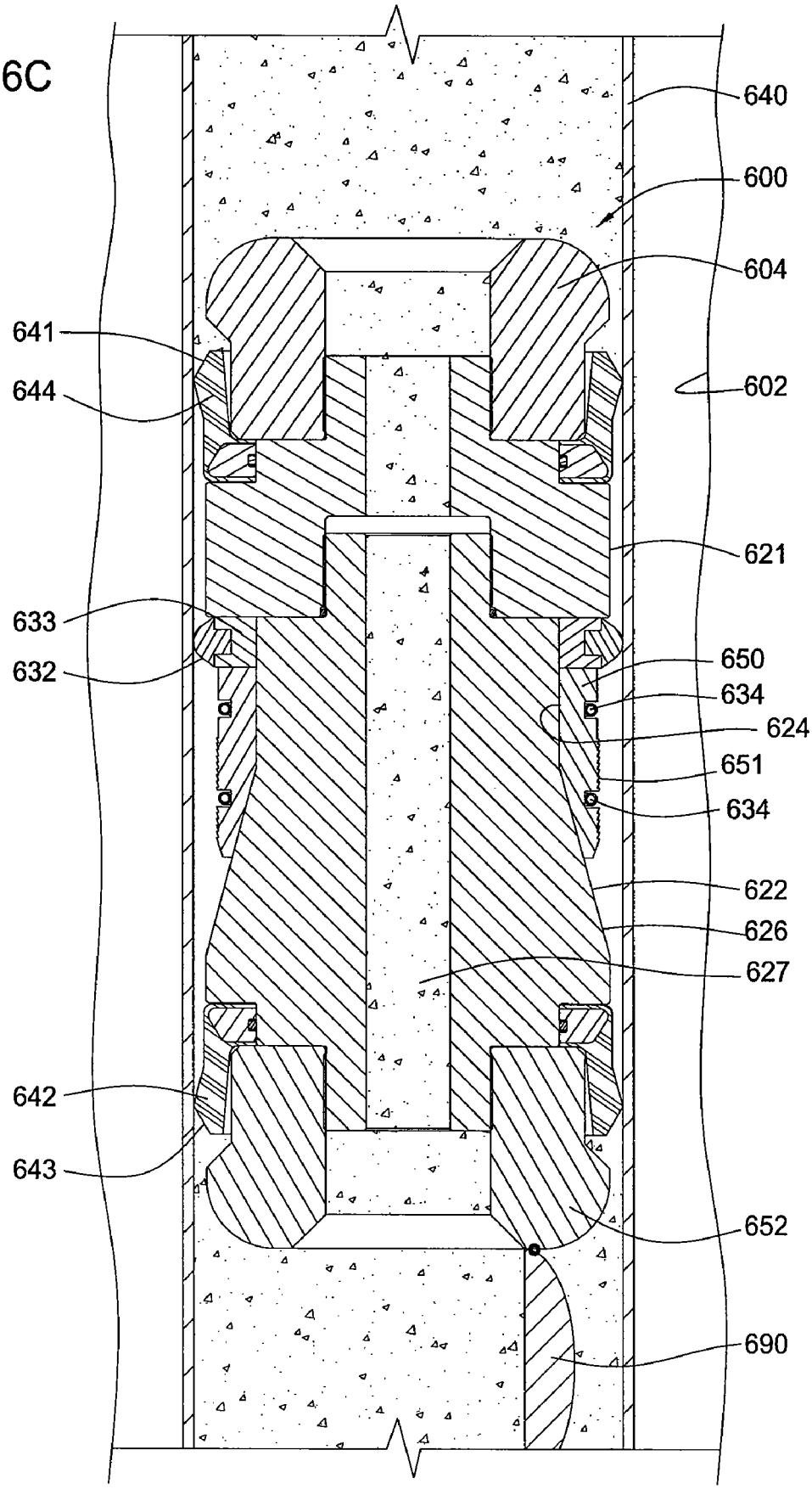
FIG. 6C is a cross-section of a single-direction plug in an unactuated position.
Figure 6D:
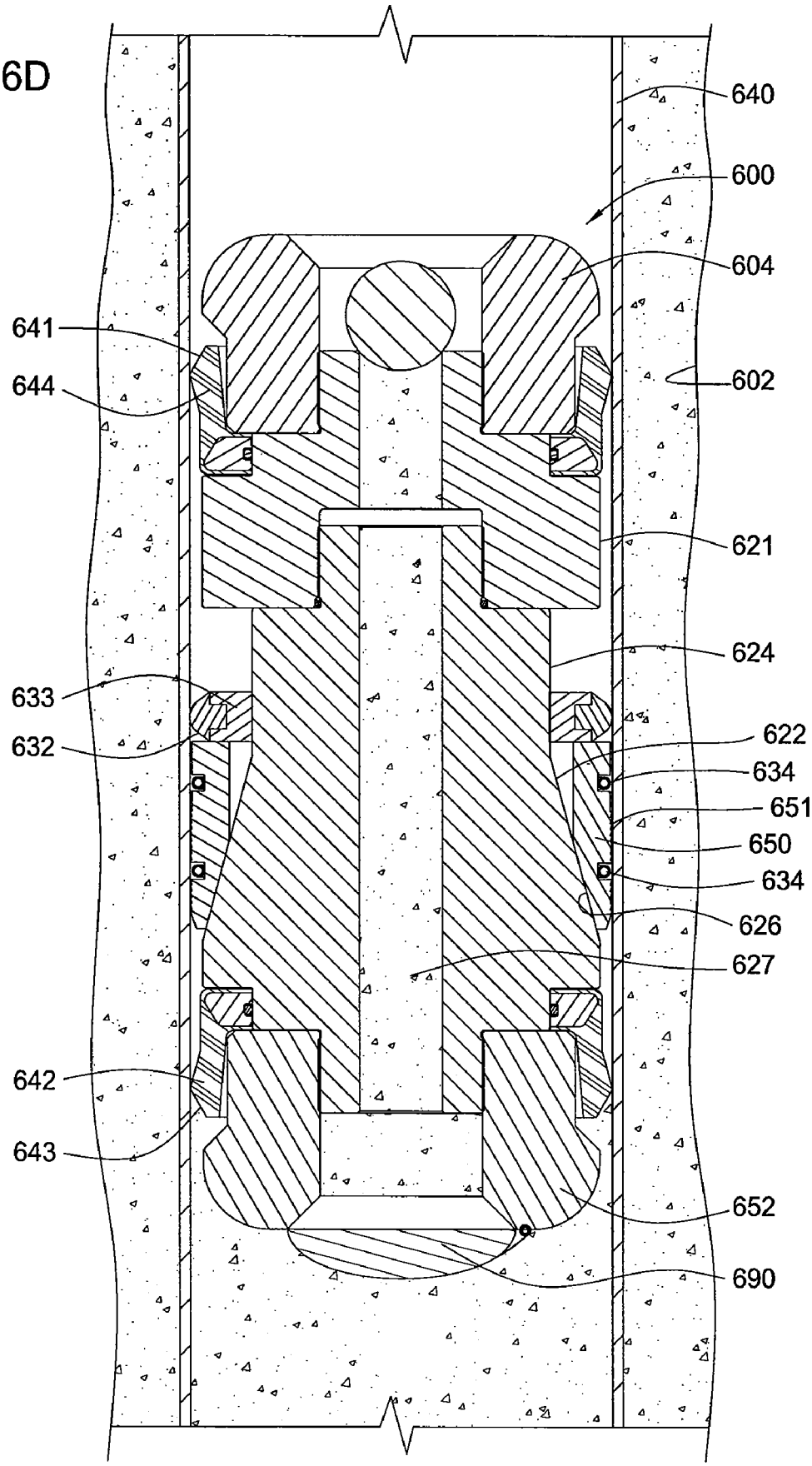
FIG. 6D is a cross-section of the single-direction plug in an actuated position.

FIG. 6C is a cross-section of the single-direction plug 600 in an unactuated position. The single-direction plug 600 may include a cylindrical body 620, one or more slips 650, a garter spring 634, a drag element 632, sealing members 644, 642, and end caps 604, 652. FIG. 6D is a cross-section of the single-direction plug 600 in an actuated position. The cylindrical body 620 of the plug 600 includes a bore 627 therethrough. A top end cap 604 may be coupled to the top end of the body 620 and a bottom end cap 652 may be coupled to the bottom end of the body 620. The end caps 604, 652 may comprise a rounded surface to help direct the plug 600 through the casing 640.

A top sealing member 644 may be coupled to the top end of the body 620 and a bottom sealing member 642 may be coupled to the bottom end of the body 620. The sealing members 644, 642 comprise lips 641, 643 which make movable contact with the inner walls of the casing 640. The lip 641 of the top sealing member 644 is directed upward to help isolate a second fluid above the plug 600 while the lip 643 of the bottom sealing member 642 is directed downward to help isolate a first fluid below the plug 600. The lips 641, 643 of the sealing members 644, 642 preferably comprise an elastic material. As shown in the figure, the body 620 comprises two pieces. In other embodiments, the body 620 may comprise one integral piece or three or more separate pieces.

The body 620 of the plug 600 further comprises a sloped portion 622 having a narrow region 624 above a wide region 626. The slips 650 are at least partially disposed around the sloped portion 622 of the body 620 and are moveable axially between the narrow region 624 and the wide region 626 of the sloped portion 622 of the body 620. The slips 650 may comprise multiple components. One or more garter springs 634 are disposed around the slips 650 to bias the slips 650 against the body 620.

The slips 650 are disposed proximate to the drag element 632. The drag element 632 comprises drag buttons disposed on a slideable ring 633. Other types of drag elements 132 may also be used. As shown, the slips 650 are not attached to the drag element 632. In other embodiments, the slips 650 may be attached to the drag element 632. As the plug 600 is directed down the wellbore, the drag element 632 drags against the inner walls of the casing 640 and urges the slideable ring 633 upward relative to the body 620. The garter spring 634 biases the slips 650 against the body 620, and biases the slips 650 upward relative to the body 620 toward the slideable ring 633. Since the slideable ring 633 and the slips 650 are urged upward, the slips 650 are at the narrow region 624 of the sloped portion 622 of the body 620 and are prevented from making contact with the inner walls of the casing 640. In other words, the slips 650 are in a retracted position, and, thus, do not hinder downward movement of the plug 600 through the casing 640.

The plug 600 is actuated when the pressure below the plug 600 is greater than the pressure above the plug 600, thereby closing flapper valve 690 and forcing the plug 600 to move up the casing 640. As the plug 600 is directed up the casing 640, the drag element 632 drags against the inner walls of the casing 640 and urges the slideable ring 633 downward relative to the body 620. The slideable ring 633 contacts the slips 650 and moves the slips 650 downward relative to the body 620 against the bias of the garter spring 634. As a consequence, the slips 650 are urged to the wide region 626 of the sloped portion 622 of the body 620. Due to the larger outer diameter of the wide region 626, the slips 650 are forced outward against the bias of the garter springs 634, thereby contacting the inner walls of the casing 640. In this respect, the slips 650 may become wedged between the inner wall of the casing 640 and the body 620, thereby preventing upward movement of the plug 600. In another aspect, the slips 650 may further comprise gripping elements 631, such as teeth, bumps, or other irregular, non-smooth, or jagged surfaces, to facilitate engagement of the slips 650 with the casing 640, and to help prevent movement of the plug 600.

Figure 7:
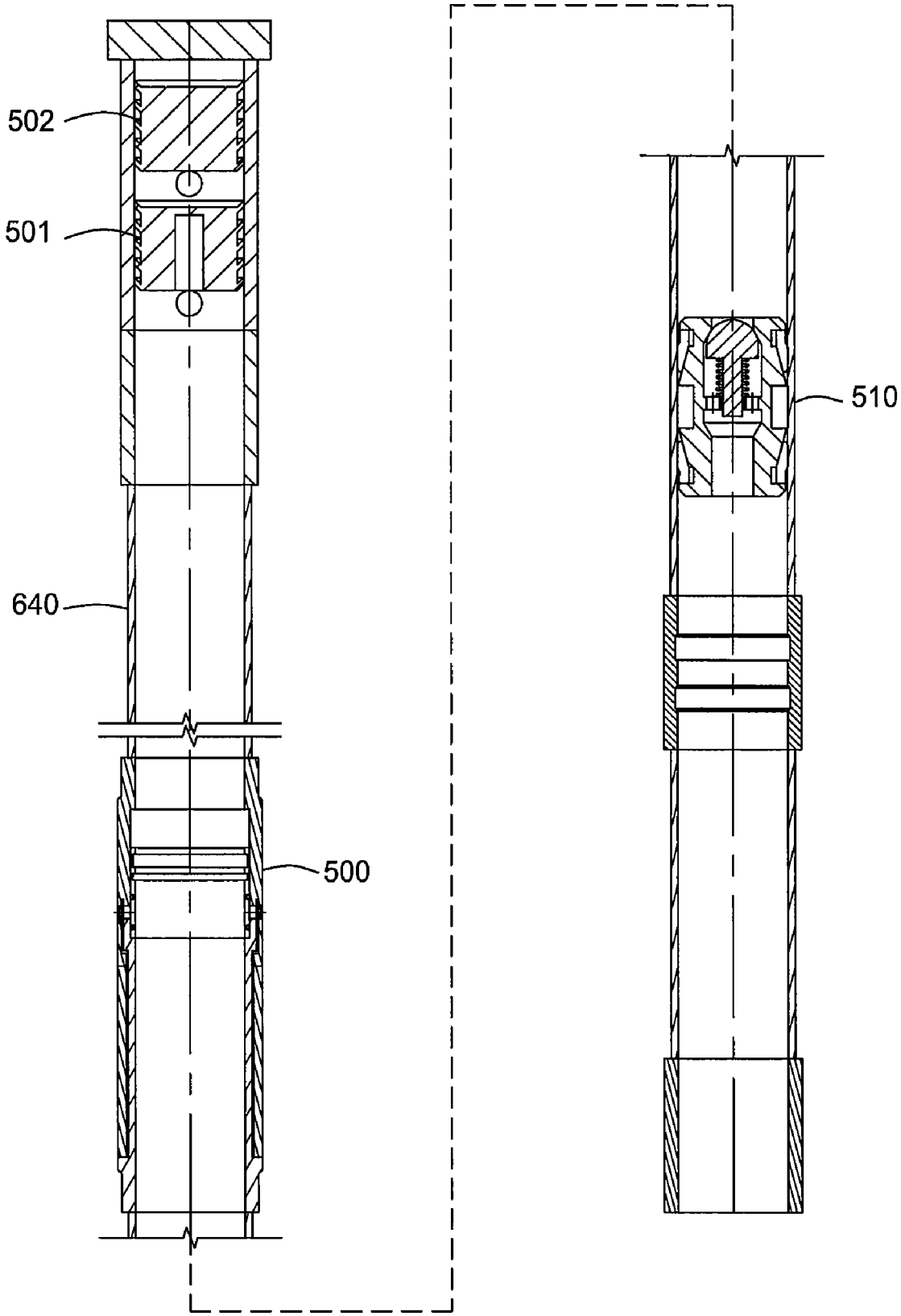
FIG. 7 shows a casing string after the drilling member has been retrieved. The casing string is equipped with a stage tool. A packer valve is disposed in the casing string.

According to another embodiment, a stage cementing tool may be provided on the drilling casing to allow for stage cementing operations. FIG. 7 shows a drilling casing after the drilling assembly has been retrieved. The drilling casing is equipped with a stage tool 500. The stage tool may be of a "full opening" type. Examples of stage tools are described in U.S. Pat. Nos. 3,768,572, 5,137,087, and 5,299,640, which are herein incorporated by reference in their entirety. The stage tool 500 does not restrict the inner diameter of the casing and allows the drilling assembly 400 to be retrieved through the inner diameter of the stage tool. Therefore, an operator may set and retrieve the casing latch and the retrievable drilling assembly 400 through the stage tool 500. A restricted inner diameter such as with some stage tools may limit the choices of latch and drilling assemblies that could be used at the bottom of the casing. In FIG. 7, drillable packer 510 is positioned in the casing 640 and a top and bottom plug system is positioned above the casing 640. A cementing operation may be performed by initially releasing the bottom plug 501 and supplying cement behind the bottom plug 501. After a predetermined amount of cement has been pumped, the top plug 502 is released to force the cement out through the bottom plug 501 and the packer 510 to fill the annulus. The top plug 502 continues to move down until it lands on the bottom plug 501 to complete the cementation. The cement is prevented from returning into the casing by the one way valve of the packer 510.

Figure 8A:
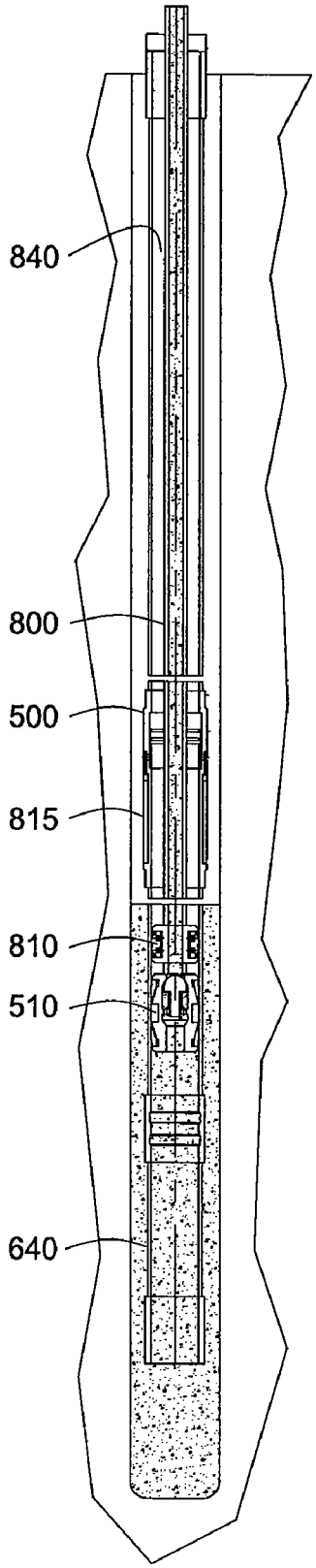
FIGS. 8A-8C shows a sequential operation of cementation of the casing string shown in FIG. 7. As shown, the stage tool is operated by a tool conveyed on a work string.
Figure 8B:
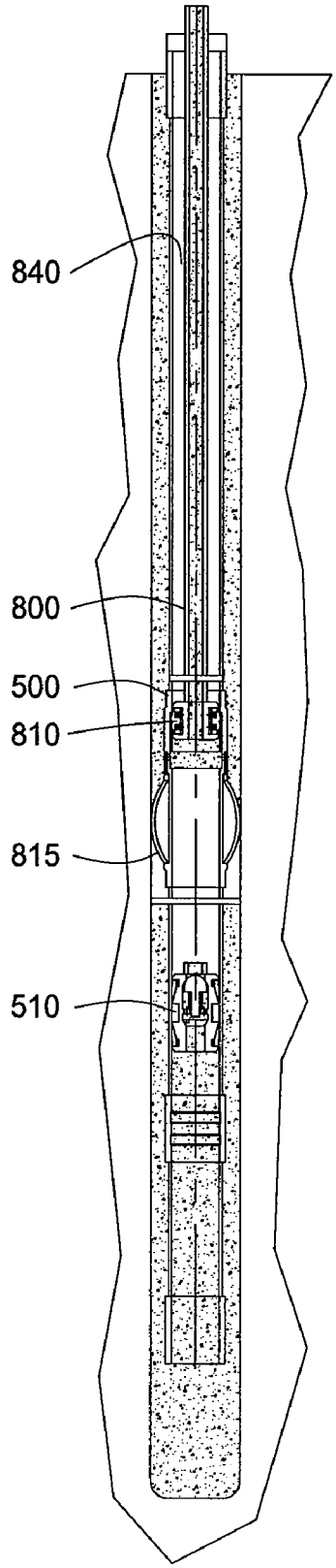
Figure 8C:
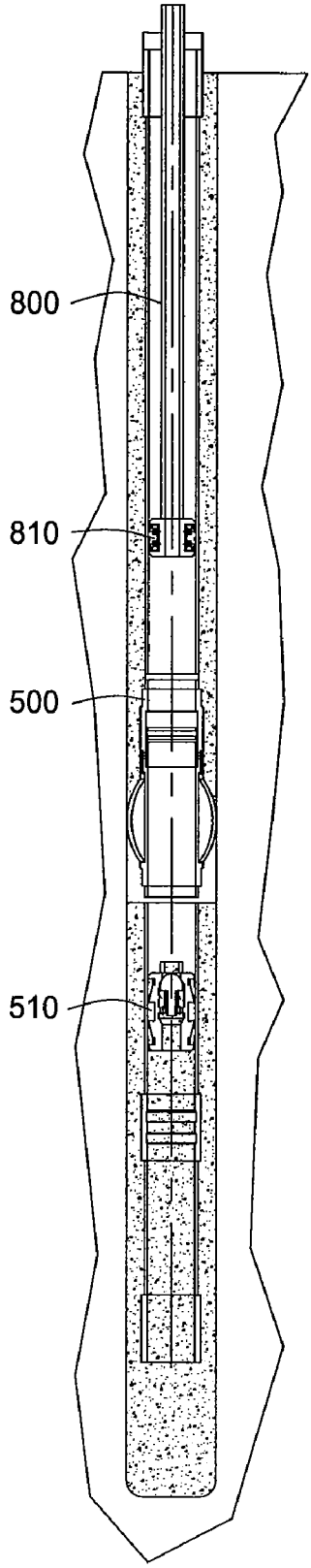

FIG. 8A-8C shows a schematic of a work string cementing system for cementing a drilling casing. As shown, the casing latch and retrievable drilling assembly has already been removed. The cementing system includes a work string 800, an operating tool 810 for the stage tool 500 connected to the work string 800, and a drillable packer 510 actuatable by the work string 800. The operating tool 810 may include locking members such as dogs or keys for engaging the sliding sleeve of the stage tool 500. The cementing procedure begins with lowering the packer 510 on the work string 800 to the predetermined location in the casing 640. The packer 510 is then set in place by the work string, for example, by supplying pressure to activate the slips on the packer 510. Cement is pumped from the surface through the work string 800, through the packer 510, and into the annulus 840, as shown in FIG. 8A. After a predetermined amount of cement has been pumped, the work sting 800 is disengaged from the packer 510, and a check valve within the packer 510 is closed, as shown in FIG. 8B. Circulation through the work string 800 may then optionally be in the standard or reverse direction in order to remove any residual cement from the inner diameter of the work string 800. The operating tool 810 is then moved by work string 800 into position to engage the stage tool 500. The stage tool 500 may be a sliding sleeve, a rotational open-close sleeve, and/or an electronic, mechanical or hydraulic tool. After the locking members of the operating tool engage the stage tool 500, the sliding sleeve is moved to the open position. In situations where the stage tool 500 has an optional annular packer 815, it is typically set after the stage tool 500 is open, but before communication is established between the work sting and the annulus between the casing and the drilled hole or a previously run casing. After the packer 510 set, a secondary opening system, such as a sliding sleeve or a rupture disk (not shown), is opened to establish circulation between the work string and the annulus. Thereafter, the second stage of cement is pumped down the work string 800, through the stage tool 500, into the annulus 840, and circulated toward the top of the hole. When sufficient cement has been pumped, the operating tool 810 is manipulated to move the sleeve of stage tool 500 to the closed position. Then, the operating tool 810 is released from the sleeve. Circulation in the work string 800 may then optionally be in the standard or reverse direction in order to remove any residual cement from the inner diameter of the work string 800, as shown in FIG. 8C. The work string 800 may then be moved to the next stage tool, if needed, for another stage or retrieved from the hole if the cementing has been completed.

Figure 9A:
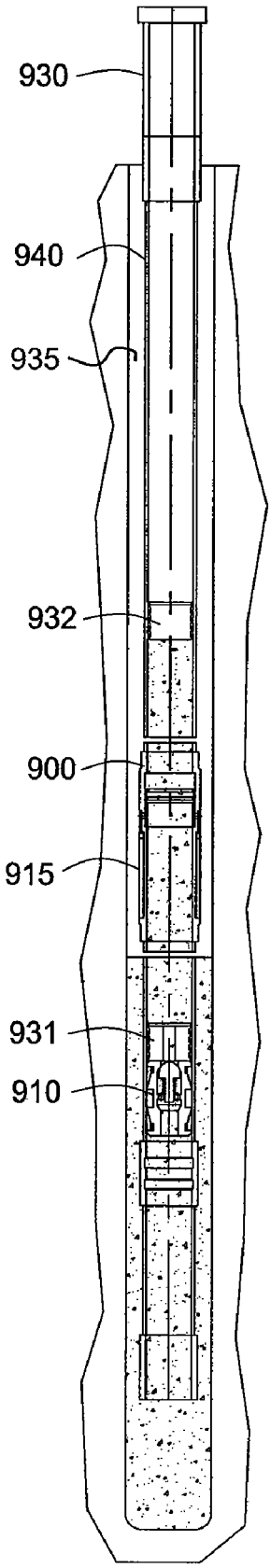
FIGS. 9A-9C shows a sequential operation of cementation of the casing string shown in FIG. 7. As shown, the stage tool is operated by a tool conveyed on a wire line.
Figure 9B:
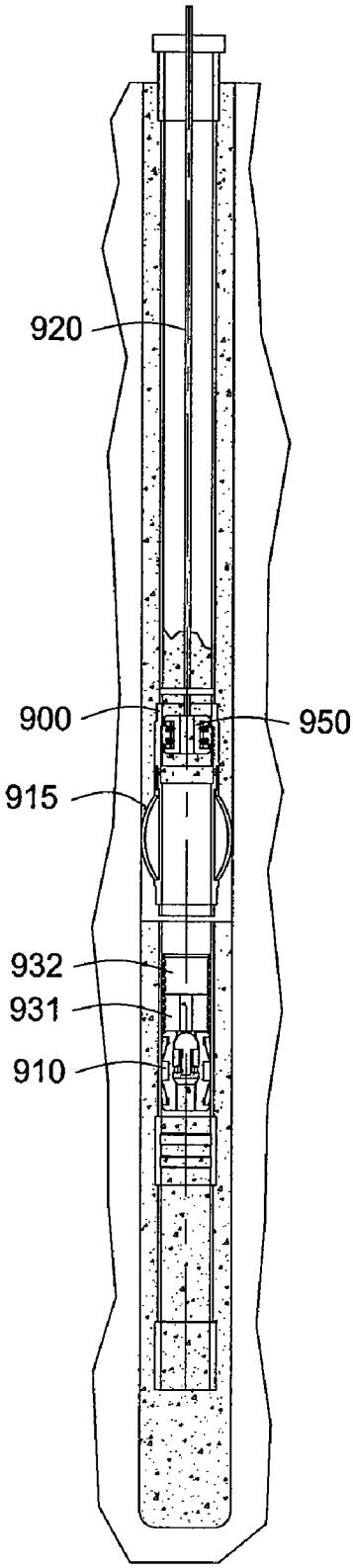
Figure 9C:
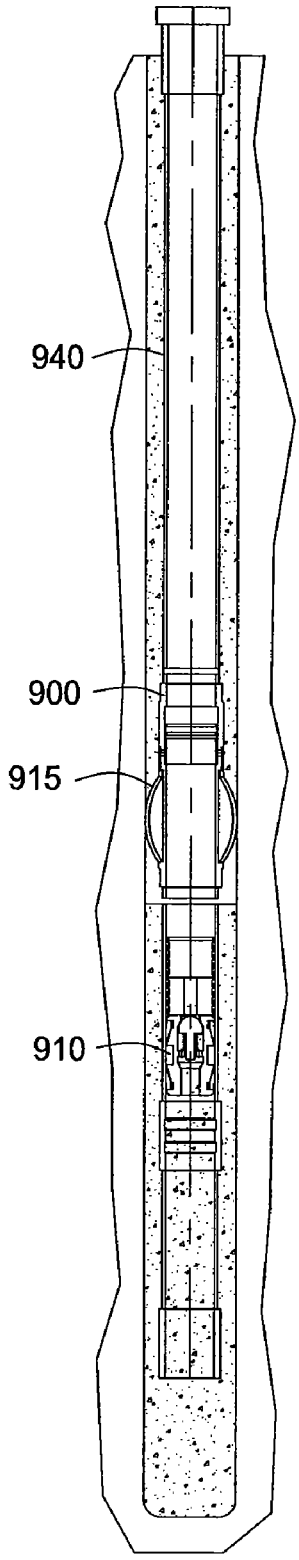

In an alternative embodiment, stage cementing of the casing 640 using the stage tool 900 may be performed using an electric line, wire line, cable, coiled tubing, corod, or slick line run cementing system. FIGS. 9A, 9B, and 9C show a schematic of a wire line stage cementing operation using the stage tool 900. In one embodiment, the stage tool may be of the full opening type. In FIG. 9A, the drillable packer 910 has already been set using a line 920 and/or plugs. A conventional plug container 930 with a top and bottom plug is shown on top of the casing 940. The top and bottom plugs may be used in conjunction with the packer 910 to complete the first stage of cementing. As shown, the bottom plug 931 has landed on the packer 910 and the top plug 932 is being pumped down to force the cement into the annulus 935. After the top plug lands on the bottom plug, the second stage cement begins by lowering an operating tool 950 for the stage tool 900 on a conveying member such as a wire line 920. FIG. 9B shows the conveying member 920 with an operating tool 950 for opening and closing the stage tool 900 for the second and possible other stages of cementing. The operating tool 950 may include a locking member for engaging the sleeve of the stage tool 900. The operating tool 950 may also have sufficient weight so that it will drop to the bottom unless it is supported by the wire line 920 or other conveying member. To open the stage tool 900, the operating tool 950 is lowered so that the locking members engage the sleeve. The operating tool 950 is pulled up to move the sleeve to the open position. Then, the packer, if present, on the stage tool 900 is set and communication with the annulus is established. Cement is pumped down the casing 940 and exits through the stage tool 900 to fill the annulus above the packer 915. After the cement is supplied, the tension on the wire line 920 is relieved to allow the operating tool 920 to move downward. The motion moves the sleeve back to the closed position. Continued downward movement of the operating tool 950 causes the operating tool 950 to disengage from the stage tool 900. Thereafter, the operating tool 950 may be retrieved by the wire line 920. FIG. 9C shows the cemented casing after the operating tool 950 has been retrieved. It must be noted that during the pumping of the cement, the operating tool 950 may remain in the casing 940 or be retrieved. If the wire line operating tool 950 is retrieved out of the casing during cementing operations, then pressure will be held on the casing inner diameter after the cement has been placed to allow the wire line tool to go back in the hole and close the stage tool 900.

Figure 10:
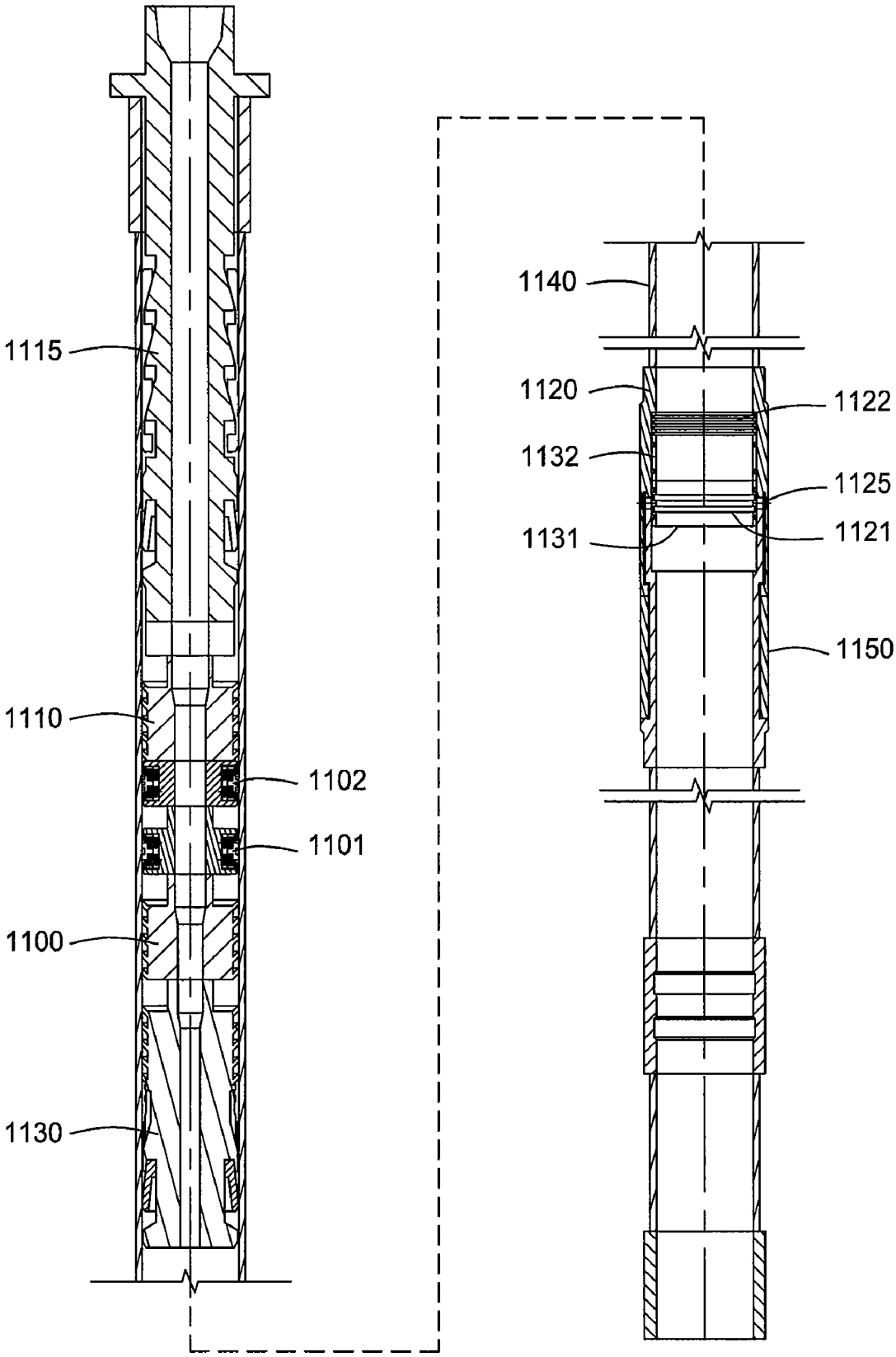
FIG. 10 illustrates an exemplary embodiment of a cementing assembly for a stage cement operation.

A key system may be used to operate the stage tool in another embodiment of the present invention, as shown in FIG. 10. FIG. 10 shows a stage tool 1120 that may be opened and closed by pump down opening and closing plugs 1100 and 1110. In one embodiment, the stage tool 1120 may be of a full opening type. Each plug 1100, 1110 includes a key portion 1101, 1102 that will match a corresponding profile 1121, 1122 machined into the open and closing seats of the stage tool 1120. In one embodiment, the keys 1101, 1102 on the plugs 1100, 1110 may be different such that they have different matching profiles 1121, 1122 in the stage tool 1120. In another embodiment, the plugs 1100, 1110 may have the same key portion, which may suitable for sequential operations. The plugs 1100, 1110 are disposed below the spear 1115, which is used to support the casing 1140. A one way top plug 1130 equipped with a one way valve may be connected below the plugs 1100, 1110 for use in the first stage cementing.

Figure 11A:
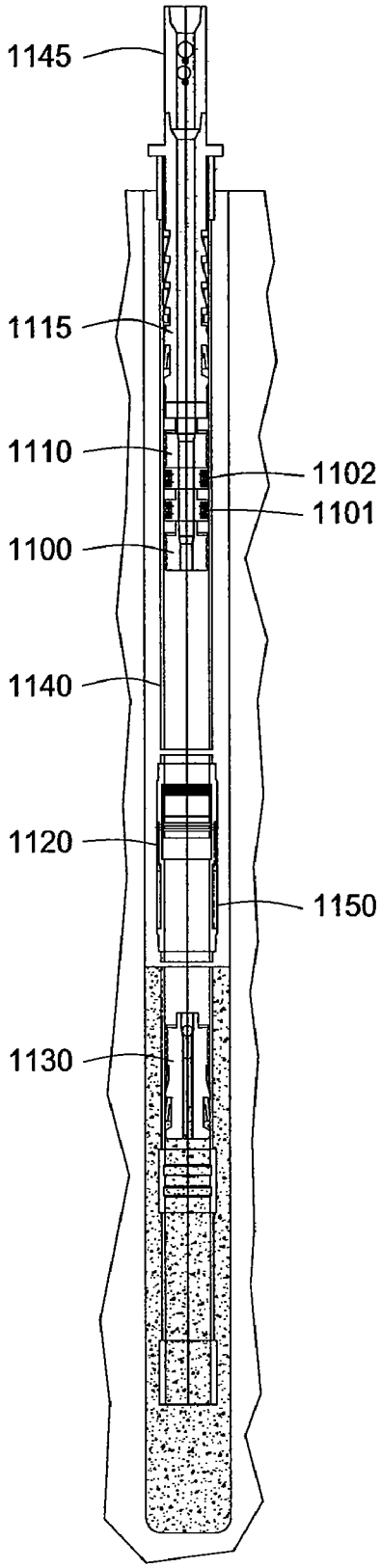
FIGS. 11A-C show a sequential stage cementing operation using the cementing assembly of FIG. 10.
Figure 11B:
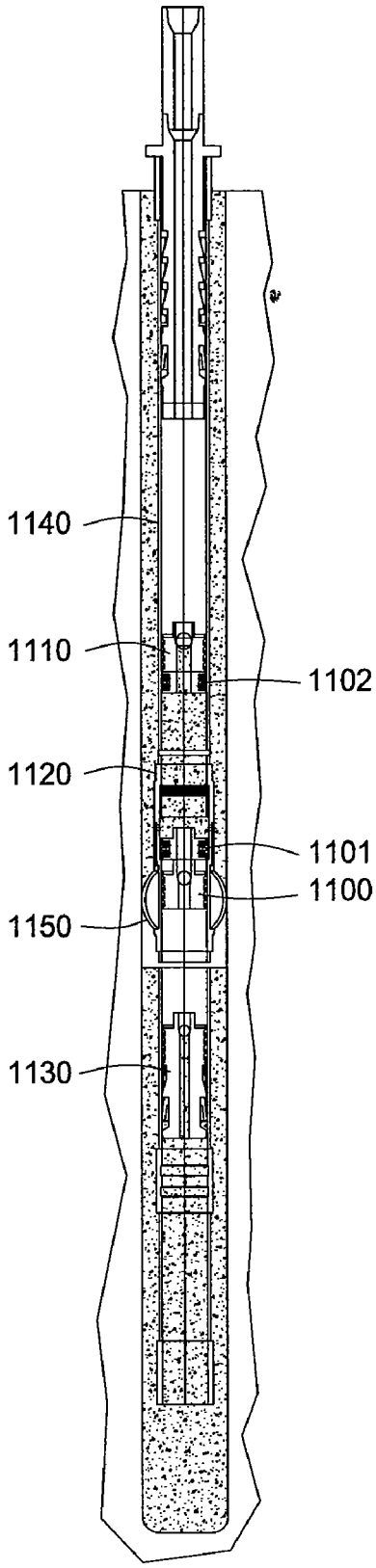

Referring to FIG. 11A, the first stage of cement is pumped followed by the one way top plug 1130. The one way top plug 1130 may be released by dropping a ball or dart from the cementing head 1145. Slips on the top plug 1130 prevent the top plug 1130 from moving back up the casing 1140, and the one way valve in the top plug 1130 prevents the cement from U-tubing. In another embodiment, the one way top plug 1130 may latch into a profile in the casing. Referring to FIG. 11B, after a specific amount of fluid has been pumped behind the top plug 1130, the opening plug 1100 is released and pumped toward the stage tool 1120. The volume of fluid pumped behind the one way top plug 1130 and in front of the second stage opening plug 1110, and/or the timing of release of the plugs, may be designed not to pump the one way top plug 1130 out of the casing 1140 before the second stage opening plug 1110 reaches the stage tool 1120 and opens it. The key portion 1101 of the opening plug 1100 engages the matching profiles 1121 on the opening sliding sleeve 1131 of the stage tool 1120. Pressure behind the opening plug 1100 causes the opening sleeve 1131 to shift down, thereby opening the port 1125 in the stage tool 1120. After the stage tool 1120 is opened, the optional annular pack-off element 1150 is set. A secondary opening system (not shown) is then opened to allow communication between the casing 1140 inner diameter and the annulus between the casing outer diameter and the drill hole inner diameter or the inner diameter of the previously run casing above the optional pack-off element 1150.

Figure 11C:
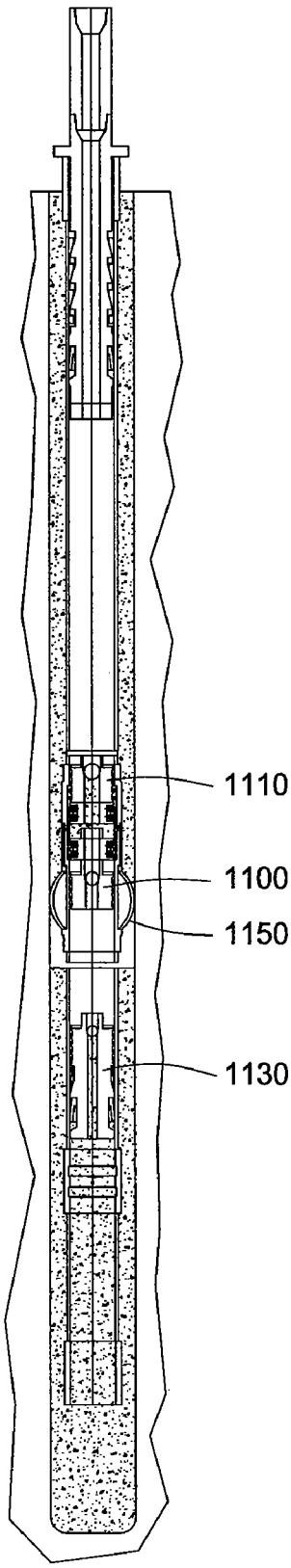

The second stage of cement is then pumped down the casing 1140 inner diameter, through the stage tool 1120, and into the annulus. The cement is followed by the keyed closing plug 1110 that will engage the matching profiles 1122 on the closing sleeve 1132 of the stage tool 1120. FIG. 11C shows the casing after second stage cementing process has completed. The plugs 1100, 1110, 1130 and excess cement left in the inner diameter of the casing 1140 may be drilled out by the following drill string, not shown.

It should be noted that a free fall opening plug may also be used with the embodiment herein if desired.

Embodiments of the present invention provide apparatus and methods for a cementing application using a stage tool. It should be noted that any combination of the above methods may be used for multiple stage cement with or without a latch.

When the stage cementer is used in reverse cementing, it is typically used, but not limited to, near the bottom of the hole and requires a external pack-off to keep the cement from going up toward the surface of the wellbore instead of down to cover the annulus between the outer diameter of the casing and the inner diameter of the bore toward the bottom of the casing. This technique requires the use of an inner string 1200 to pump the cement down and to allow returns back through the inner diameter of the casing. (See FIGS. 12A-12F).

Figure 12A:
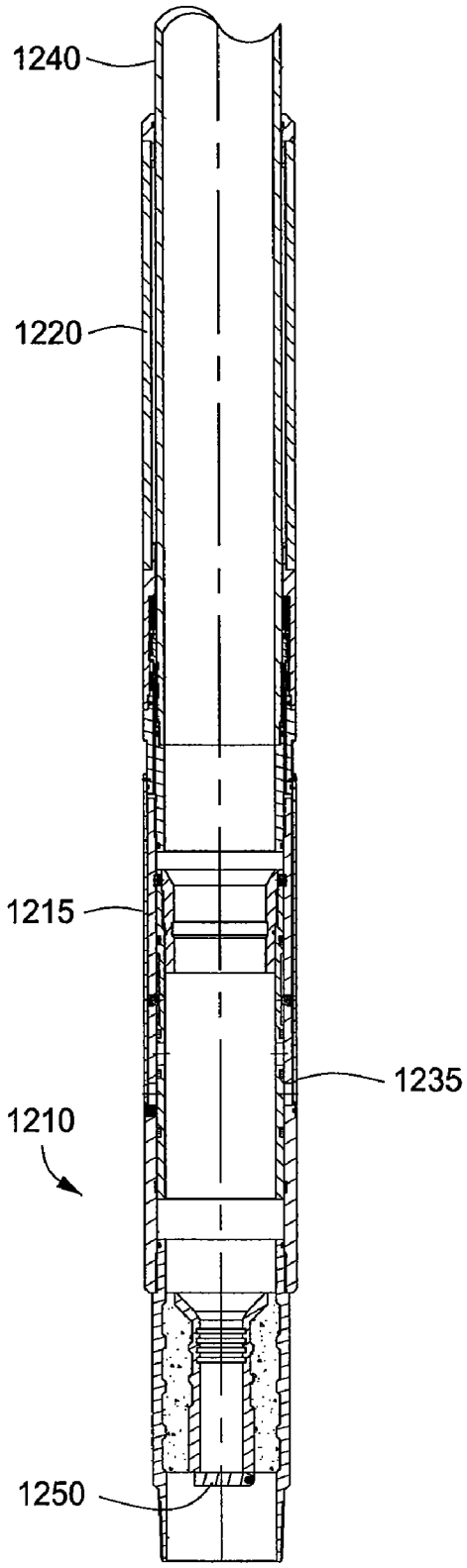
FIGS. 12A-12F illustrate an embodiment of an apparatus and method for reverse cementing.
Figure 12B:
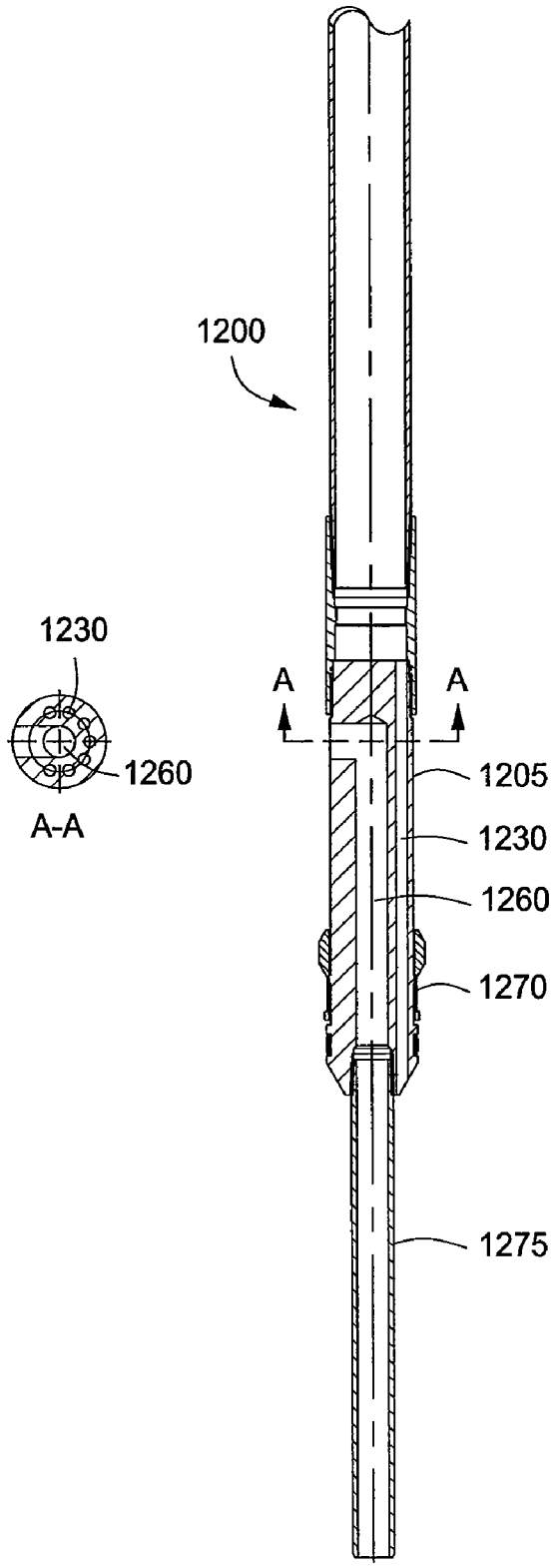
Figure 12C:
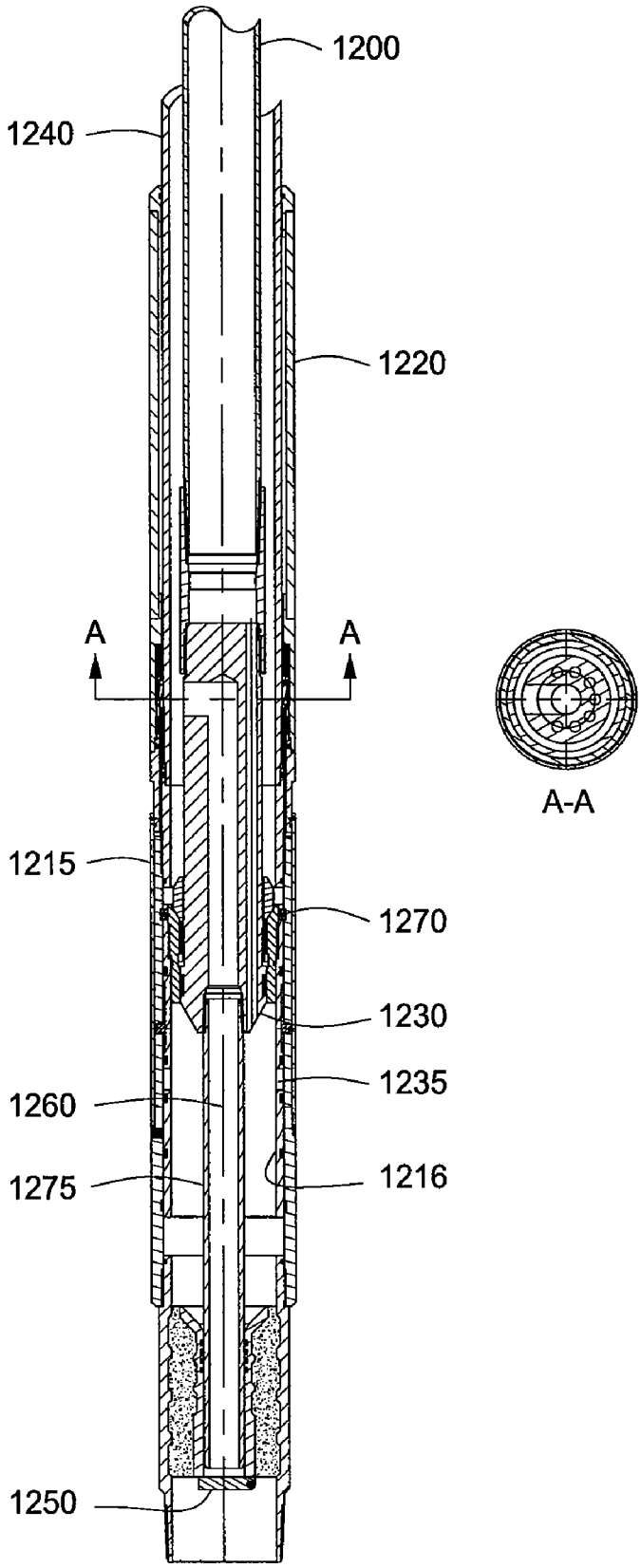
Figure 12D:
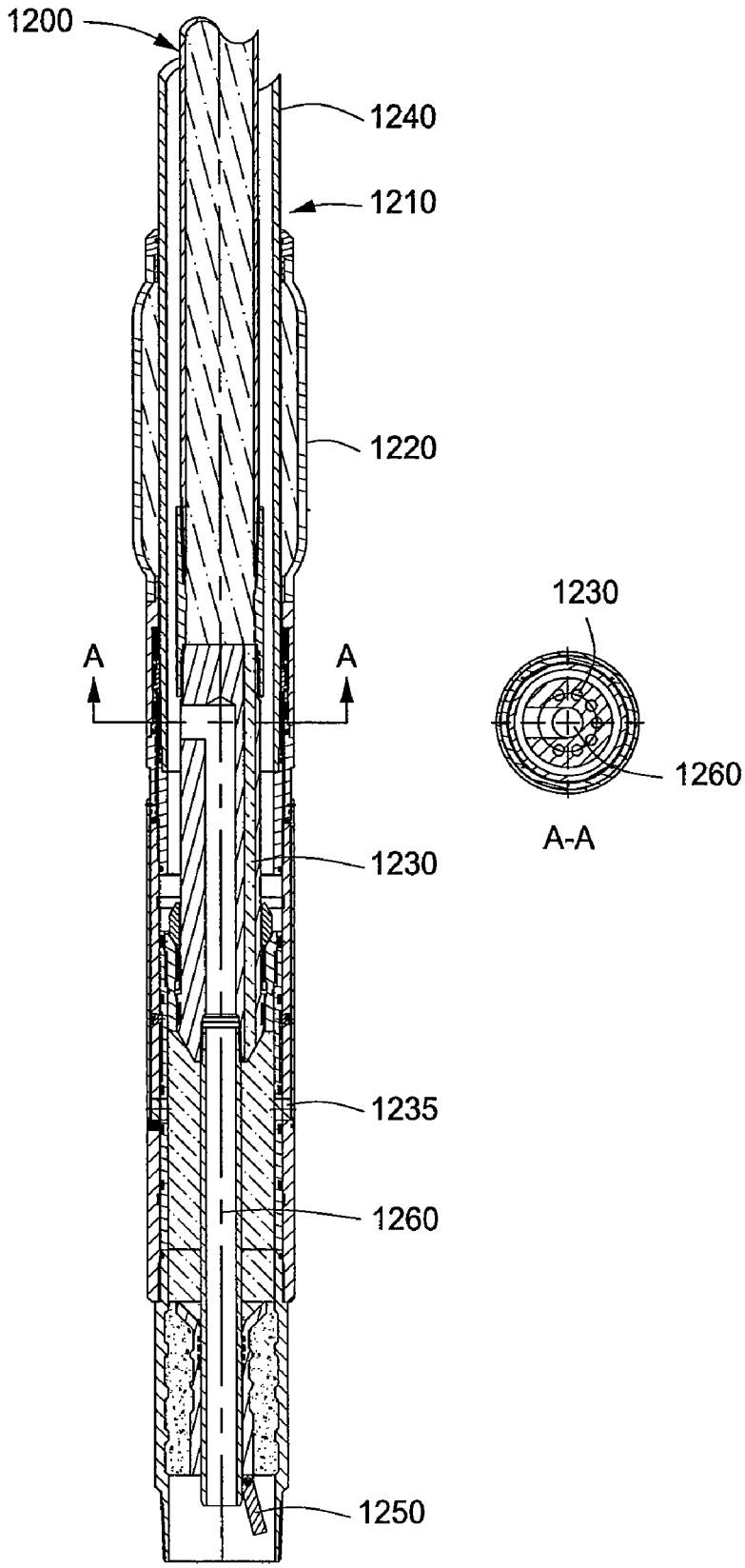
Figure 12E:
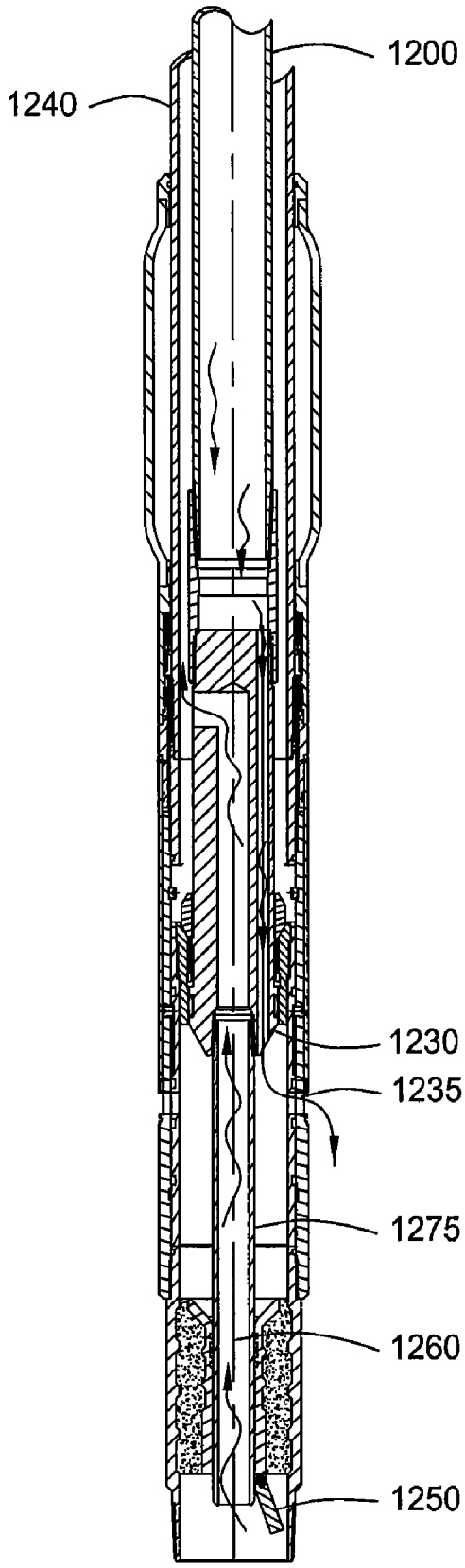
Figure 12F:
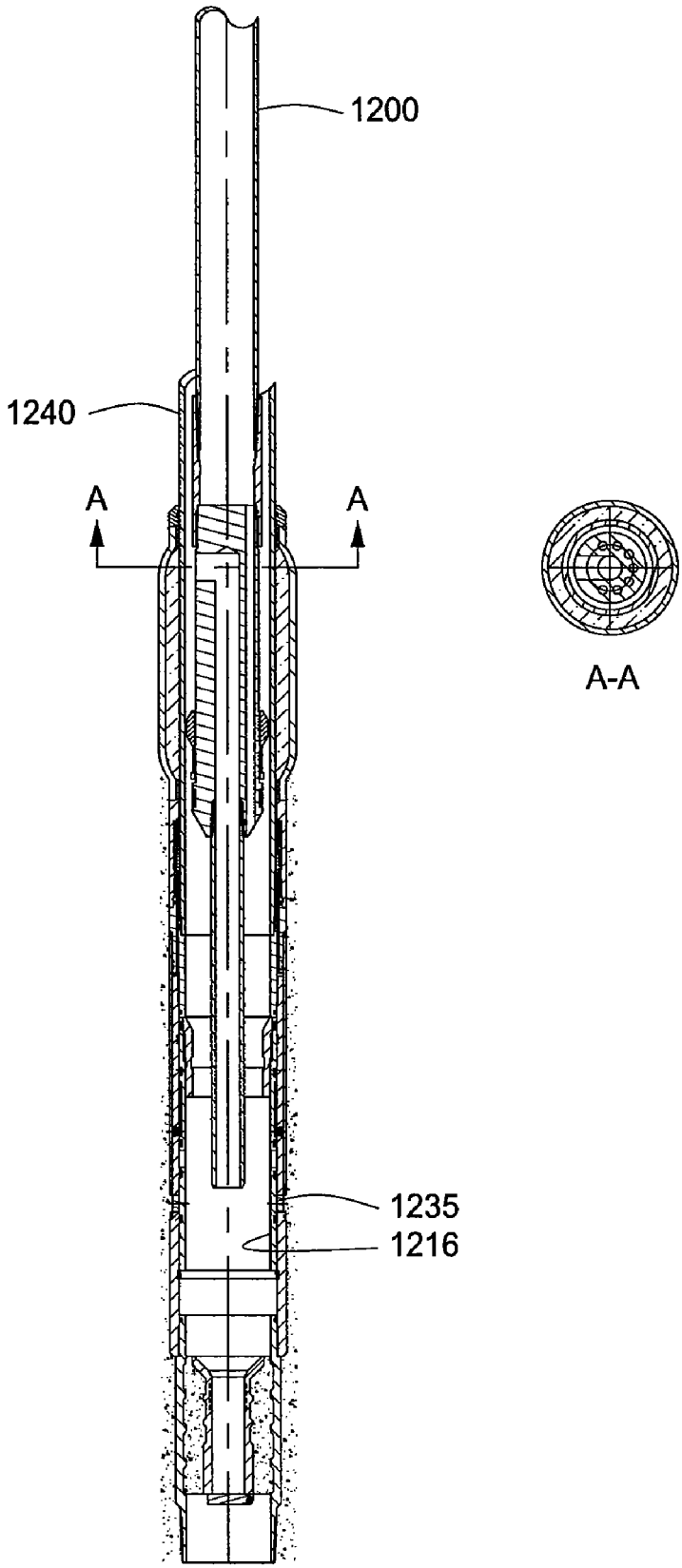

FIGS. 12A-B show an embodiment of a cementing apparatus for a reversing cementing operation. FIG. 12A shows a casing assembly 1210 having a packer 1220, a port collar 1215, and a cement valve 1250. FIG. 12B shows an inner string 1200 adapted to be inserted into the casing assembly 1210 to regulate fluid flow. The inner string 1200 includes a fluid crossover tool 1205, a port collar operating tool 1270, and a stinger 1275. The fluid crossover tool 1205 includes one or more bypass ports 1230 and a reverse flow port 1260. FIG. 12C shows the inner string 1200 inserted into the casing assembly 1210. As shown, the port collar operating tool 1270 has engaged the sliding sleeve 1216 in the port collar 1215. In FIG. 12D, the inner string 1200 has moved axially to shift the sliding sleeve 1216 down to open the port 1235 in the port collar 1215. The downward shift also causes the stinger 1275 to open the cement valve 1250. Initially, the fluid such as cement is pumped down to inflate the packer 1220. After inflation, a second opening sleeve shifts up to open a port to the annulus between the casing 1240 and the wellbore. Then, cement flows down the interior of the inner string 1200 and into the bypass port(s) 1230 and exits to the interior of the casing 1240 adjacent the port 1235 of the port collar 1215. FIG. 12E shows the flow route of the cement. The cement then flows through the port 1235 and down the annulus between the casing and the wellbore until it reaches the lower end of the casing 1240. The fluid that was behind the casing in front of the cement then flows into the stinger 1275 and the cement valve 1250, up the reverse flow port 1260, and up the annular area between the inner string 1200 and the casing 1240. Once a pre-determined amount of cement has been pumped, the cementing operation is complete. The inner string 1200 is removed from the casing 1240 and the cement valve 1250 is closed. As the inner string 1200 is pulled, it also pulls the sleeve 1216 to close the port 1235. In another embodiment, the cement valve 1250 may be opened by any suitable method known in the art. In yet another embodiment, the cement may flow into the casing through an opening in the casing other than the cement valve 1250.

In another embodiment, a method of cementing a wellbore includes drilling the wellbore using a drilling member coupled to a casing; opening a stage tool positioned at an intermediate location in the casing string; and performing a cementing operation through the stage tool. In yet another embodiment, the method may include performing an optional cementation through the lower end of the casing.

In one or more of the embodiments described herein, the provision and inflation of the packer on the stage tool may be optional.

In one or more of the embodiments described herein, the stage tool may be used to cement an intermediation portion of the casing and first stage cementing through the lower portion of the casing may be omitted. In yet another embodiment, the stage tool cementation may be performed with or without the isolation packer.

Figure 13:
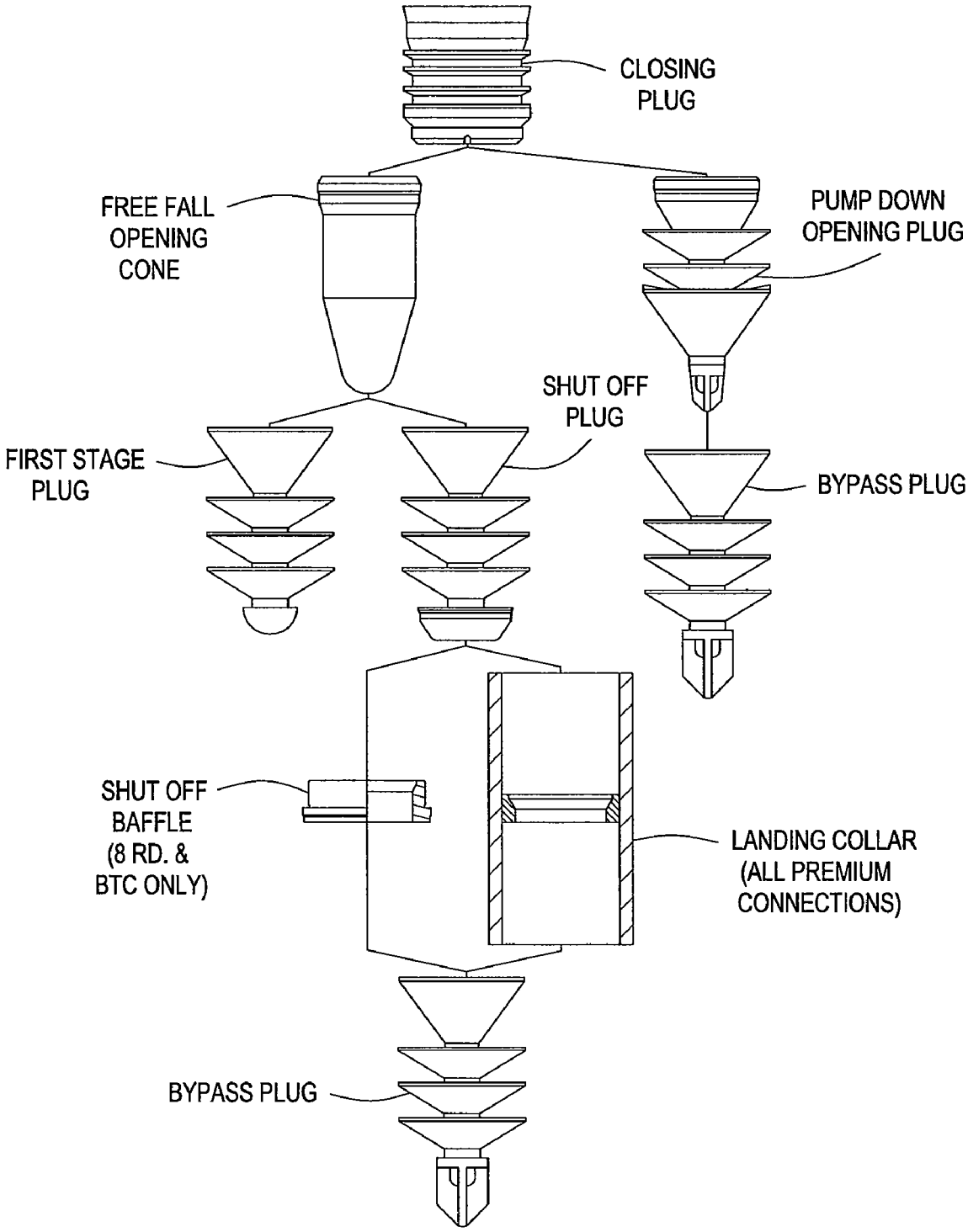
FIG. 13 is a schematic of plugs used in cementing operations.

Exemplary plugs used for the multiple stage cementing operations include but are not limited to the plugs shown in FIG. 13.

While the foregoing is directed to embodiments of the present invention, other and further embodiments of the invention may be devised without departing from the basic scope thereof, and the scope thereof is determined by the claims that follow.

The invention claimed is:

1. A method of cementing a wellbore, comprising:

drilling the wellbore using an assembly comprising: a casing, a drilling member coupled to the casing, a float collar coupled to the casing, and a stage tool coupled to the casing;

opening ports in the drilling member;

performing a first cementing operation using the float collar and the open ports, wherein the float collar comprises a one way valve allowing flow of cement through the casing and into an annulus formed between the casing and the wellbore and preventing backflow of the cement into the casing;

opening the stage tool located in the casing;

performing second cementing operation through the open stage tool; and drilling out the drilling member and the float collar.

2. The method of claim 1, wherein the stage tool is opened using a plug.

3. The method of claim 1, further comprising closing the stage tool.

4. The method of claim 3, wherein the stage tool is closed using a plug.

5. The method of claim 1, further comprising setting a packer prior to the second cementing operation.

6. The method of claim 1, wherein the ports in the drilling member are opened by releasing a ball into the casing, landing the ball in the drilling member, and applying pressure to the drilling member.

7. The method of claim 6, wherein landing the ball in the drilling member and applying pressure to the drilling member also displaces blades of the drilling member.

8. A method of cementing a wellbore, comprising:

drilling the wellbore using a drilling member coupled to a casing;

retrieving the drilling member from the casing;

pumping cement into the casing and through a one way plug;

launching the one way plug behind the cement;

pumping fluid behind the plug, thereby propelling the cement through the casing and into an annulus formed between the casing and the wellbore, wherein:

pumping is stopped to retain the plug within the casing, and the plug anchors to the casing in response to the pumping stoppage, thereby retaining the cement in the annulus and preventing backflow of the cement into the casing.

9. The method of claim 8, further comprising launching a bottom plug into the casing ahead of the cement, wherein the bottom plug is pumped through the casing and into the wellbore.

10. The method of claim 8, wherein:

a stage tool is located in the casing, the method further comprises launching an opening plug into the casing, and the opening plug lands in the stage tool and opens the stage tool.

11. The method of claim 10, wherein the opening plug is launched after pumping a predetermined volume of fluid so that the opening plug lands in and opens the stage tool while the top plug is still in the casing.

12. The method of claim 10, wherein the opening plug free-falls to the stage tool.

13. The method of claim 10, further comprising pumping cement through the open stage tool and into the annulus, wherein a closing plug is pumped behind the cement, lands in the stage tool, and closes the stage tool.

14. The method of claim 10, wherein the opening and closing plugs are keyed to match respective profiles in the stage tool.

15. A method of cementing a wellbore, comprising:

drilling the wellbore using a drilling member coupled to a casing;

retrieving the drilling member from the casing;

deploying an electric, wire or slick line into the casing;

setting a packer in the casing using the line, wherein the packer has a one-way valve;

pumping cement through the casing and one-way valve and into an annulus formed between the casing and the wellbore, wherein the one-way valve retains the cement in the annulus and prevents backflow of the cement into the casing;

opening a stage tool located in the casing string using the line;

pumping cement through the casing and open stage tool and into the annulus; and closing the stage tool using the line.

16. The method of claim 15, further comprising drilling out the packer.

17. A method of cementing a wellbore, comprising:

drilling the wellbore using a drilling member coupled to a casing;

performing a first cementing operation;

opening a stage tool located in the casing, wherein:

the stage tool comprises a housing, a sleeve, an opening seat, and a closing seat, a housing port is aligned with a sleeve port in the open position, and a wall of the sleeve covers the housing port in a closed position;

performing a second cementing operation through the open stage tool; and drilling out the seats, wherein the sleeve remains after drill out.

* * * * *